US007234737B2

(12) United States Patent
Kalsi

(10) Patent No.: US 7,234,737 B2
(45) Date of Patent: Jun. 26, 2007

(54) ACTUATOR FOR A VEHICLE DOOR LATCH

(75) Inventor: Gurbinder Singh Kalsi, Oldbry (GB)

(73) Assignee: ArvinMeritor Light Vehicle Systems (UK) Ltd., Birmingham (GB)

( * ) Notice: Subject to any disclaimer, the term of this patent is extended or adjusted under 35 U.S.C. 154(b) by 272 days.

(21) Appl. No.: 10/960,651

(22) Filed: Oct. 7, 2004

(65) Prior Publication Data

US 2005/0110279 A1 May 26, 2005

(30) Foreign Application Priority Data

Oct. 8, 2003 (GB) ..... 0323521.5

(51) Int. Cl.
*E05C 3/06* (2006.01)

(52) U.S. Cl. ..... 292/201; 292/216

(58) Field of Classification Search ..... 292/216, 292/201, DIG. 23
See application file for complete search history.

(56) References Cited

U.S. PATENT DOCUMENTS 5,423,582 A * 6/1995 Kleefeldt ..... 292/201
6,386,599 B1 * 5/2002 Chevalier ..... 292/201
6,526,790 B2 * 3/2003 Wegner ..... 70/277
2002/0074809 A1 * 6/2002 Fisher ..... 292/216

FOREIGN PATENT DOCUMENTS

| | | |
|---|---|---|
| EP | 0 205 750 | 2/1986 |
| FR | 2 457 699 | 12/1980 |
| GB | 2 360 544 | 9/2001 |

OTHER PUBLICATIONS

United Kingdom Search Report dated Mar. 30, 2004.

* cited by examiner

*Primary Examiner*—Gary Estremsky
(74) *Attorney, Agent, or Firm*—Carlson, Gaskey & Olds

(57) ABSTRACT

A latch of a vehicle includes a displacement member having a first position, a second position, and an intermediate rest position and an output movable between a first output position and a second output position. A first mode of operation is possible where the output lever is driven between the first output position and the second output position by a stepper motor and a second mode of operation is possible where the output lever can be moved between the first output position and the second output position independently from the stepper motor. A common control controls all the latches in the vehicle.

27 Claims, 23 Drawing Sheets

SUPER LOCKED

UNLOCKED - CHILD SAFETY OFF

SUPER LOCKED

LOCKED - CHILD SAFETY ON

UNLOCKED - CHILD SAFETY ON

LOCKED - CHILD SAFETY OFF

UNLOCKED - CHILD SAFETY OFF

RELEASE

LOCKED

ACTUATOR FOR A VEHICLE DOOR LATCH

REFERENCE TO RELATED APPLICATION

This application claims priority to United Kingdom Patent Application GB 0323521.5 filed on Oct. 8, 2003.

BACKGROUND OF THE INVENTION

The invention relates to an actuator for a vehicle door latch and particularly, but not exclusively, for use in a vehicle, where the latch forms part of a vehicle central and/or remote locking system.

There are, principally, two methods of latch actuation known in the art. The two methods are distinct in the way a relative movement is generated in the transmission path between an actuator power source, usually a DC motor, and a latch mechanism. This relative movement allows the latch mechanism to be manually locked without requiring back driving of the power source.

In the first method, the relative movement is generated by a centrifugal clutch arranged between the DC motor and the latch mechanism.

In the second method, the latch mechanism is driven by the DC motor via a lever that is movable within a lost motion space before engagement with the latch mechanism. The lever is biased to a rest position between two outer positions that correspond to a locked and an unlocked status of the latch mechanism. Upon locking a master door, the DC motor in each of the slave doors drives the lever to a physical stop corresponding to the locked position. With the lever driven to the physical stop, the DC motor remains in a stalled state for a fixed period of time, typically between 0.1 and 0.8 seconds. The power to the DC motor is then stopped and the lever is returned to an intermediate rest position by a biasing member.

However, both of these methods of actuation have distinct disadvantages. In both methods, the DC motor is repeatedly driven to stall, increasing motor fatigue and reducing reliability. A further disadvantage of the first method is that the DC motor must overcome the friction of a centrifugal clutch. Likewise, in the second method, the DC motor must load the biasing member before the latch mechanism is actuated. In both methods, this results in poor efficiency of actuation.

SUMMARY OF THE INVENTION

The present invention provides an improved latch actuator for a vehicle door latch.

The term "remote locking" refers to the automated locking or unlocking of the doors of a vehicle upon receiving a command signal sent from a remote transmitter device. "Central locking" refers to the locking or unlocking of the doors of a vehicle after the manual locking of the door. The door can be locked externally by a key barrel or internally by a sill button.

A typical arrangement for a central/remote locking system for a four door vehicle with a trunk lid is as follows. A remote locking and unlocking device unlocks or locks all four doors and the trunk lid. Central locking or unlocking of the vehicle also locks or unlocks all four doors and the trunk lid. The front passenger door can be locked or unlocked independently of the other doors, and this can typically be achieved from the interior or exterior of the vehicle. The rear doors can be independently locked or unlocked from the interior of the vehicle, and the trunk lid can be independently locked or unlocked from the exterior of the vehicle.

Since any one of the rear doors, the passenger door or the trunk lid could potentially be locked or unlocked independently of any other door, all of the doors and the trunk lid do not necessarily have the same lock status at any given time. Consequently, remotely locking or centrally locking the vehicle may require the status of some latches to change and the status of other latches to remain unchanged. It should be ensured that the correct lock status is achieved on receiving a lock or unlock command.

A latch includes an actuator having a stepper motor, and a displacement member having a first position, a second position, and an intermediate rest position. The displacement member includes first and second driving surfaces. An output is movable between a first output position and a second output position and includes first and second driven surfaces. The stepper motor is arranged to drive the displacement member between the first position, the second position and the intermediate rest position. The first driving surface is engageable with the first driven surface to move the output to the first output position, and the second driving surface is engageable with the second driven surface to move the output to the second output position. Movement of the displacement member to the first position causes the output to move to or remain in the first output position, and movement of the displacement member to the second position causes the output to move to or remain in the second output position. During powered operation, the stepper motor is powered to move the displacement member from the rest position to one of the first position or the second position, and the stepper motor is then powered to return the displacement member to the intermediate rest position. The first and second driving surfaces and the first and second driven surfaces are arranged such that the output may also be moved from the first output position to the second output position independently of the displacement member, and the movement of the output between the first output position and the second output position causes a change in latch status.

Preferably, this arrangement allows for a first mode of operation where the output lever is driven between the first output position and the second output position by the stepper motor and a second mode of operation where the output lever can be moved between the first output position and the second output position independently from the stepper motor. This allows the motor to not be required to backdrive upon manual operation of the output lever.

A further advantage of the invention is that a biasing member is not required since the motor returns the displacement member to the rest position. This reduces the power requirement of the motor since it does not have to overcome the resilience of the biasing member to actuate the displacement member.

Another advantage of the invention is that the motor is not required to stall. In the prior art, the motor needed to stall because the displacement member is driven onto a physical stop. Since the stepper motor of the present invention can achieve fixed rotation about a known datum, the positioning of the displacement member can be achieved without a physical stop.

A second aspect of the present invention provides a vehicle having two or more latches, and the stepper motors are controlled by a common control.

A third aspect of the present invention provides a system having a first latch, a second latch, and a controller to control the electric actuation of stepper motors of the first latch and the second latch. With the output of the first latch in a first output position, the output of the second latch in a second output position, and the displacement members of the first latch and the second latch in their respective intermediate rest positions, powered operation of the controller powers the stepper motors of the first latch and the second latch to move both displacement members to one of the first position or the second position to synchronize both outputs. Powered operation of the controller powers both displacement members to their respective intermediate rest positions.

Preferably, the second and third aspects of the invention allow the motors of a plurality of latches to act synchronously upon the remote or central locking or unlocking of a latch. The motors are able to move synchronously from a common rest position to a common locked position or unlocked position and back to the common rest position. A common latch status is achieved in the latches without requiring each latch motor to perform a specific operation on receipt of a specific instruction from a common control. Instead, all the latch motors receive the same signal, irrespective of the initial latch condition. This simplifies the software required to control the latches and minimizes the complexity and amount of wiring required to control the latches.

Because the motor does not have to stall, the time taken to move the motors synchronously from the rest position to a locked position or unlocked position and back to the rest position is reduced. This reduces the motor load because the total drive time is reduced, the load to overcome the biasing member is eliminated, and the load required to stall the motor is eliminated.

For clarify, the following terms relating to latch locking states will be defined. A latch is in an unlocked security condition when operation of an inside release member or an outside release member unlatches the latch. The latch is in a locked security condition when operation of the outside release member does not unlatch the latch, but operation of an inside release member does unlatch the latch. The latch is in a superlocked security condition when operation of the outside release member or the inside release member does not unlatch the latch. Multiple operations of the inside release member and the outside release member, in any sequence, does not unlatch the latch. The latch is in a child safety "on" security condition when operation of the inside release member does not unlatch the latch, but operation of an outside release member may or may not unlatch the latch depending on whether the latch is an unlocked or locked condition.

Override unlocking is a function whereby operation of the inside release member, with the latch in a locked condition, causes unlocking of the latch. Override unlocking applies to a latch in a locked child safety "off" condition and a latch in a locked child safety "on" condition. In particular, for a latch in a locked child safety on condition having override unlocking, an actuation of the inside release member will unlock the door, but this operation or any subsequent operation of the inside release member will not unlatch the door since the child safety feature is on. Nevertheless, once the latch has been unlocked by actuation of the inside release member, a subsequent operation of the outside release member will unlatch the latch. This situation is different from a superlocked latch because a particular sequence of release member operations i.e., operation of the inside release member followed by operation of the outside release member will unlatch the latch. This is not the case for superlocking.

One pull override unlocking is a function where a single actuation of the inside release member results in unlocking of the door and also unlatching of the door with the latch in a locked child safety "off" condition.

Two pull override unlocking is a function where a first actuation of the inside release member unlocks the latch but does not unlatch the latch with the latch in a locked child safety "off" condition. However, a further operation of the inside release member will then unlatch the latch.

These and other features of the present invention will be best understood from the following specification and drawings.

BRIEF DESCRIPTION OF THE DRAWINGS

The invention will now be described by way of example with reference to or as shown in the accompanying drawings, in which

FIG. 12 is the latch mechanism of FIG. 11 in a locked position with child safety on;

FIG. 13 is the latch mechanism of FIG. 11 in an unlocked condition with the child safety on;

DETAILED DESCRIPTION OF THE PREFERRED EMBODIMENT

Figure 1:
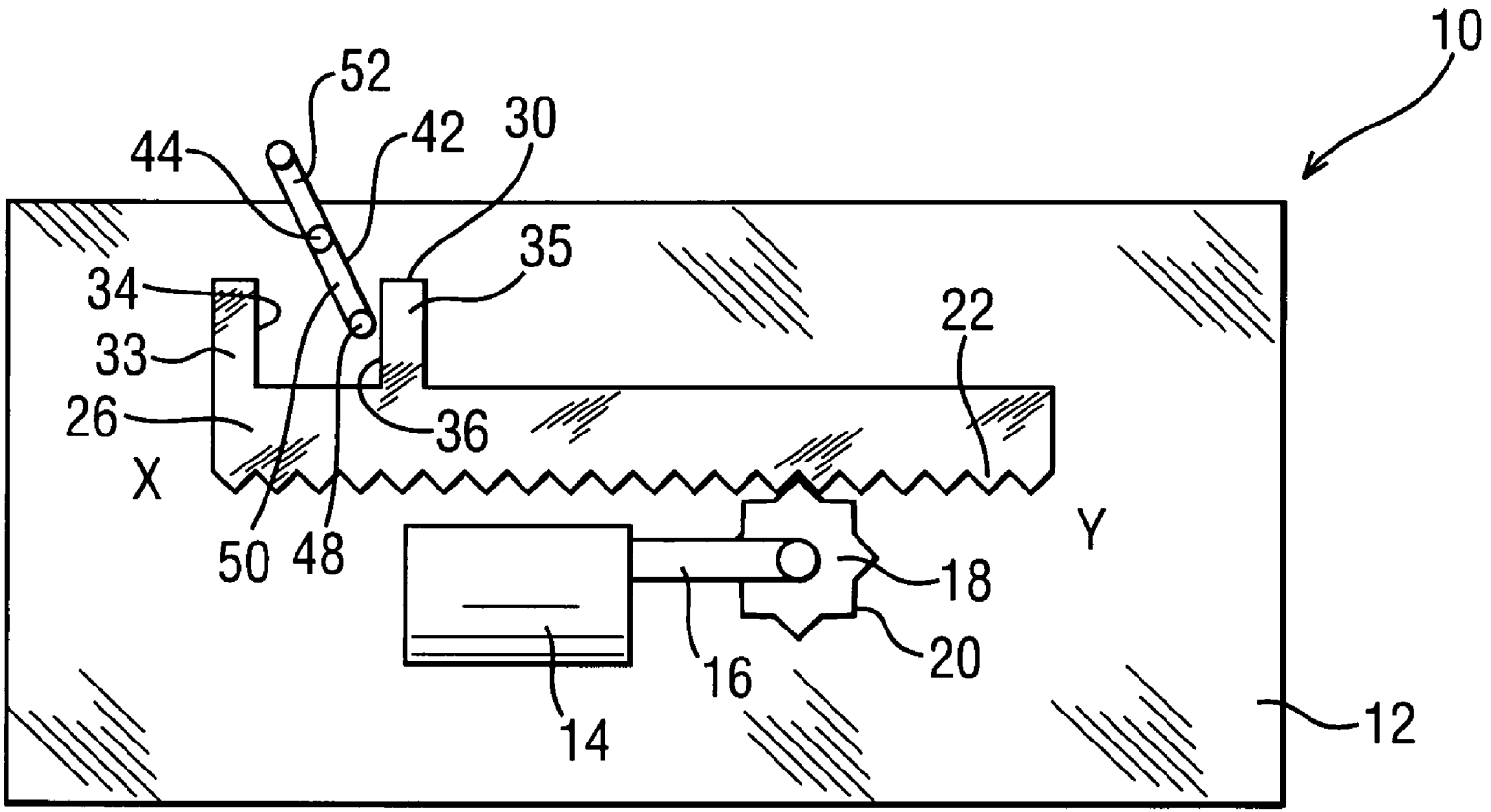
FIG. 1 is a schematic representation of an actuator in accordance with the present invention where a output lever is in a second output position and the displacement member in a rest position.

FIG. 1 illustrates an actuator 10 having a stepper motor 14 fixed to an actuator body 12. A pinion 18 having pinion teeth 20 is mounted on and driven by a stepper motor shaft 16 of the stepper motor 14. The pinion 18 engages with a displacement member 26 by a rack 22 disposed on a surface of the displacement member 26.

The displacement member 26 is movable in relation to the actuator body 12 in a first direction towards a first end X and a second direction towards a second end Y. The displacement member 26 is shown in a rest position 30.

The displacement member 26 has a first abutment 33 located at the first end X. A second abutment 35 is spaced apart from the first abutment 33 to define opposing first and second abutment surfaces 34 and 36.

Figure 2:
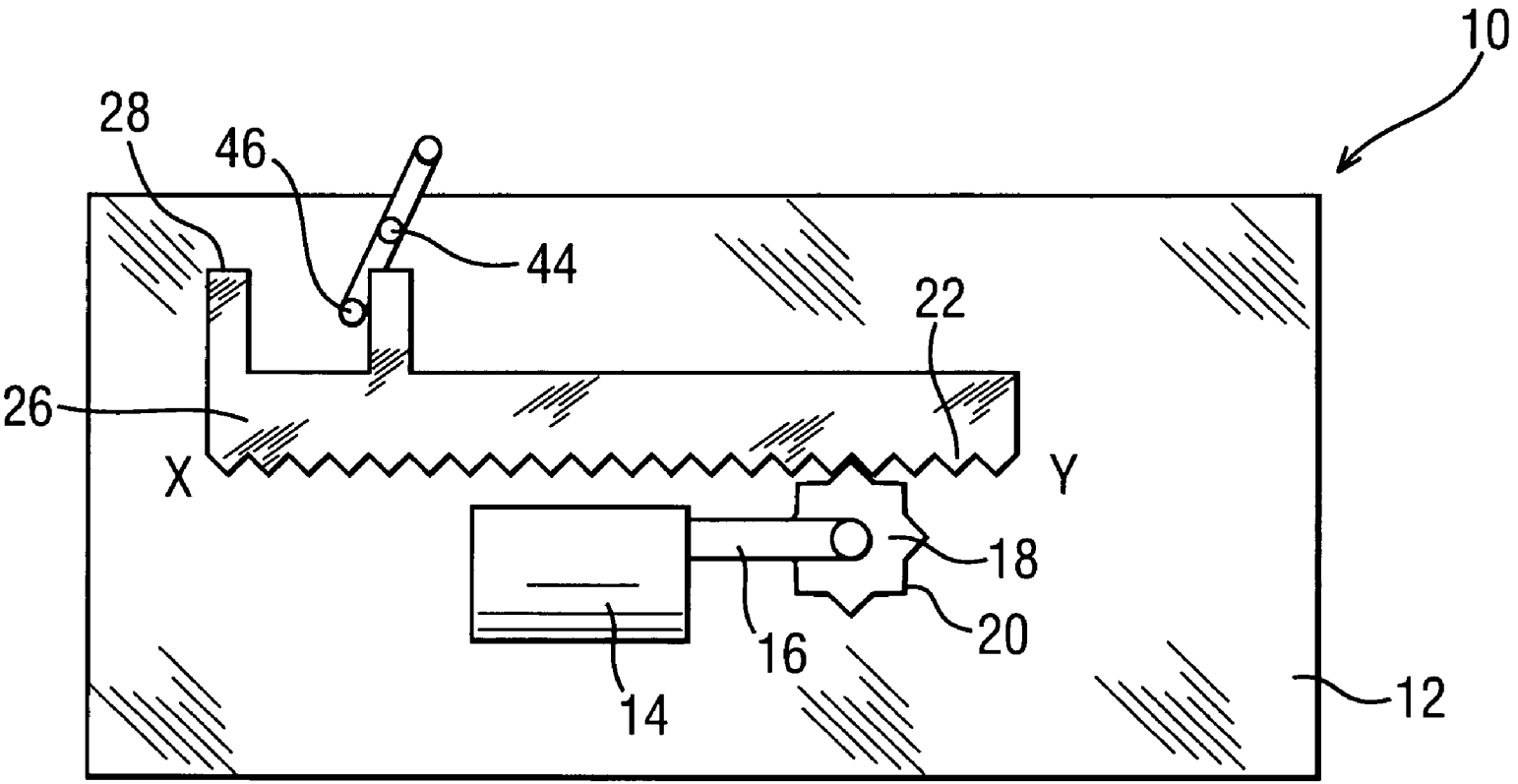
FIG. 2 is a schematic representation of the actuator of FIG. 1 where the actuator has been remotely instructed to effect a first output position in the output lever by driving the displacement member to the first position before immediately returning to the rest position.

An output lever 42 is pivoted relative to actuator body 12 via a pivot 44 and includes an actuator arm 50 on one side of the pivot 44 and an output arm 52 on the other side of the pivot 44. The actuator arm 50 of the output lever 42 is disposed between the first and second abutment surfaces 34 and 36 of the displacement member 26. As shown in FIG. 1, the output lever 42 is in a second output position 48 when the actuator arm 50 is disposed towards the second end Y of the displacement member 26. The output lever 42 also has a first position, as shown in FIG. 2, for example. The output lever 42 can be moved between the first position and the second position, as will be described below.

The output lever 42 is operable by one of two methods. First, electric or remote operation of the stepper motor 14 moves the output lever 42. Second, manual movement of the output lever 42 is also possible.

The electrical operation of the output lever 42 will be now be considered, where FIG. 1 represents the first stage (i.e., the start position) of operation of the actuator 10. FIG. 2 represents the second stage of operation of the actuator 10. The second stage is achieved momentarily between the first stage and the third stage.

In FIG. 2, the stepper motor 14 has driven the displacement member 26 via the rack 22 and the pinion 18 to move momentarily to a first position 28. The movement of the displacement member 26 causes the second abutment surface 36 to engage the actuator arm 50 of the output lever 42. This in turn drives the output lever 42 to a first output position 46. The position of the displacement member 26 is only maintained for a fraction of a second before the stepper motor 14 drives the displacement member 26 to return to the rest position 30, as shown in FIG. 3.

Figure 3:
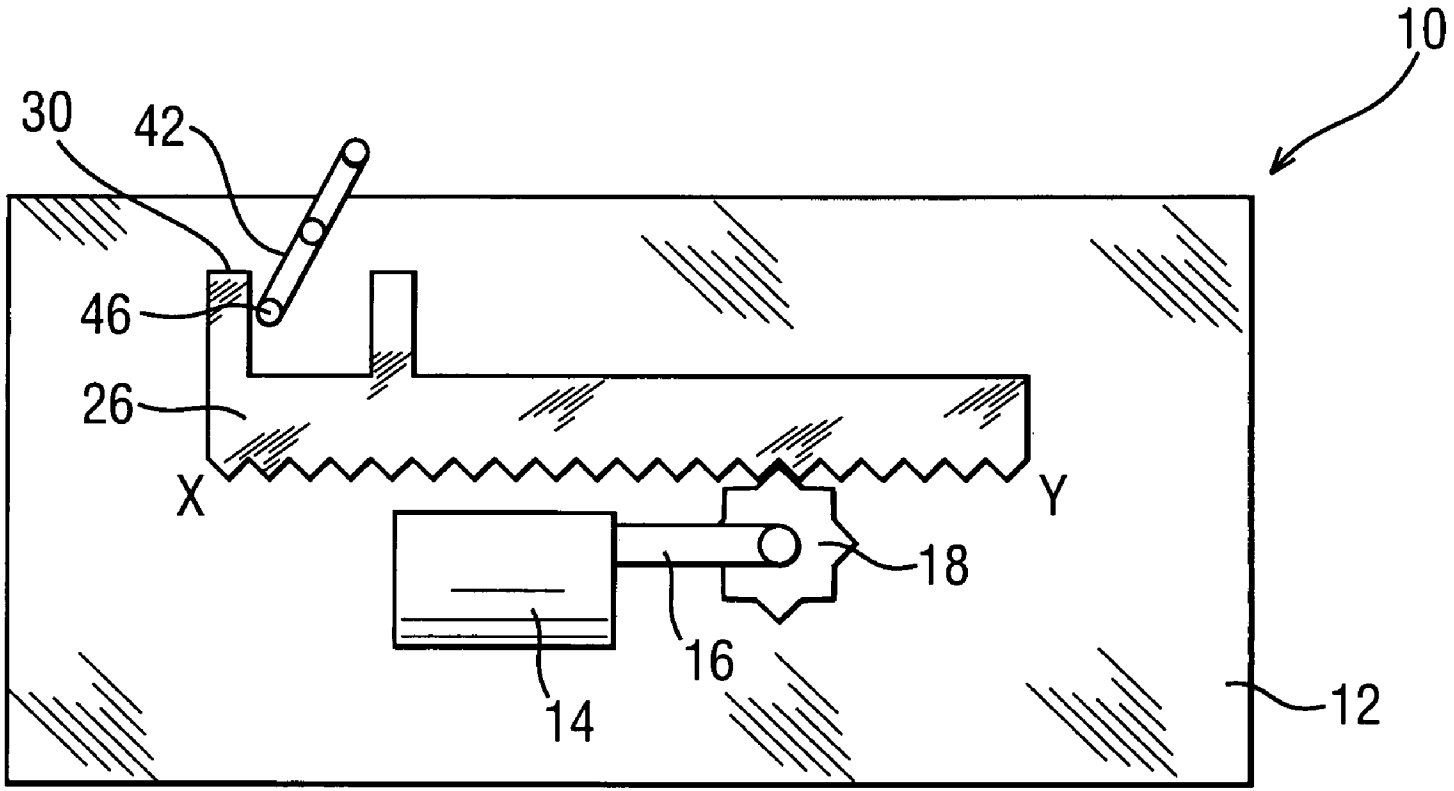
FIG. 3 is a schematic representation of the actuator of FIG. 2 where the displacement member has returned to the rest position with the output lever remaining in the first output position.

Referring now to FIG. 3, which represents the third stage of operation of the actuator 10, the output lever 42 remains in the first output position 46 while the displacement member 26 has returned to the rest position 30.

The execution of the operations depicted in FIGS. 1 to 3 causes the automatic displacement of the output lever 42 from a second output position 48 to a first output position 46. The output lever 42 can also be electrically moved from the first output position 46, shown in FIG. 3, to the second output position 48, shown in FIG. 1, in a similar manner by appropriate operation of the stepper motor 14.

The manual operation of the output lever 42 will now be considered.

Starting at the position shown in FIG. 1, the output lever 42 is moved to the position shown in FIG. 3 electrically as described above.

Figure 4:
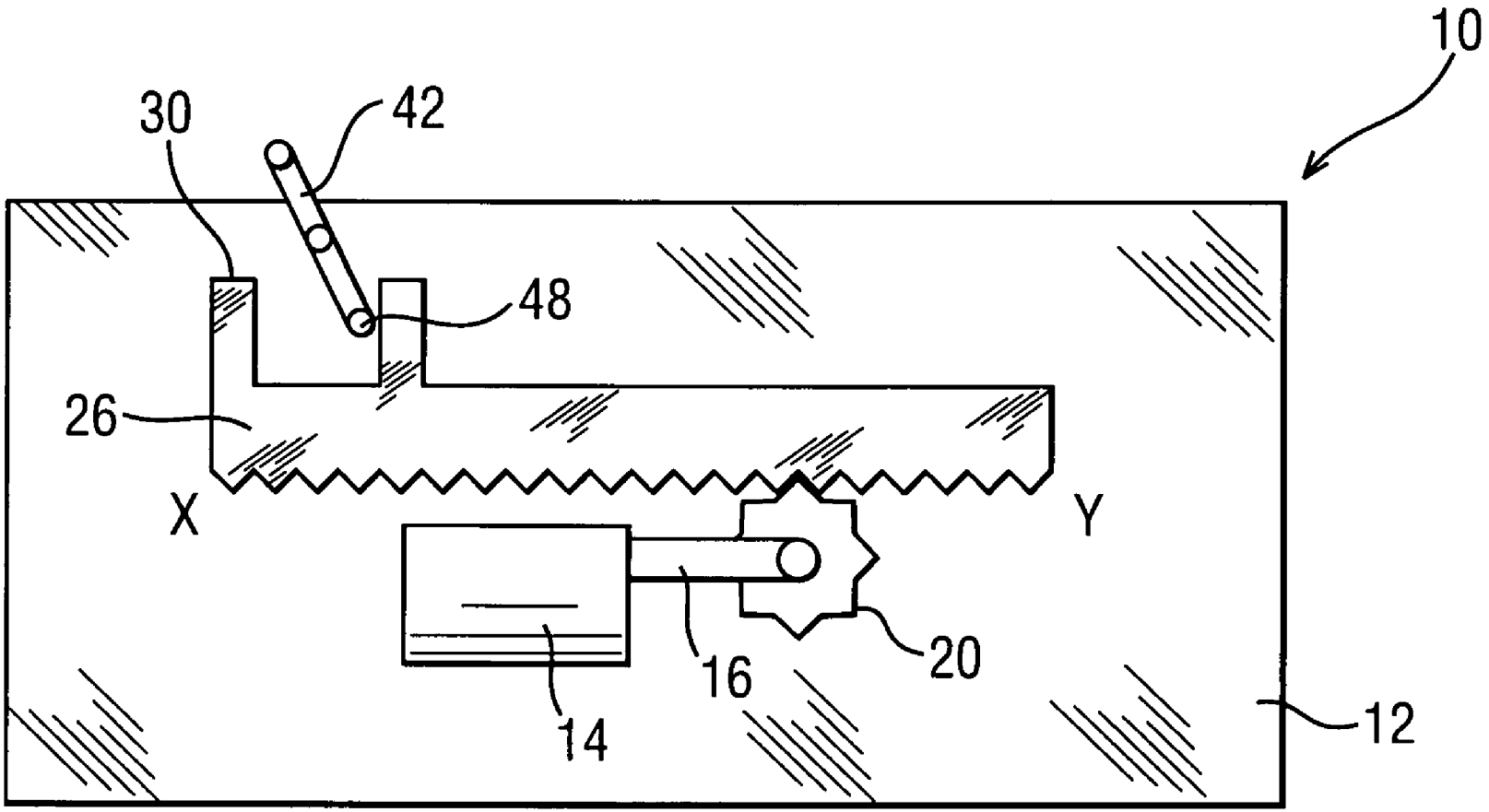
FIG. 4 is a schematic representation of the actuator of FIG. 3 where the output lever has been moved manually to the second output position.

In FIG. 4, the output lever 42 has been returned manually to the second output position 48. However, the displacement member 26 has not moved from the rest position 30 since the first and second abutment surfaces 34 and 36 are spaced apart such that the output lever 42 is moveable between the first output position 46 and the second output position 48 independently of the displacement member 26.

The arrangement depicted in FIG. 1 is identical to that depicted in FIG. 4. However, FIG. 1 shows a rest position, while FIG. 4 shows a transient position, as will now be described in further detail.

Figure 5:
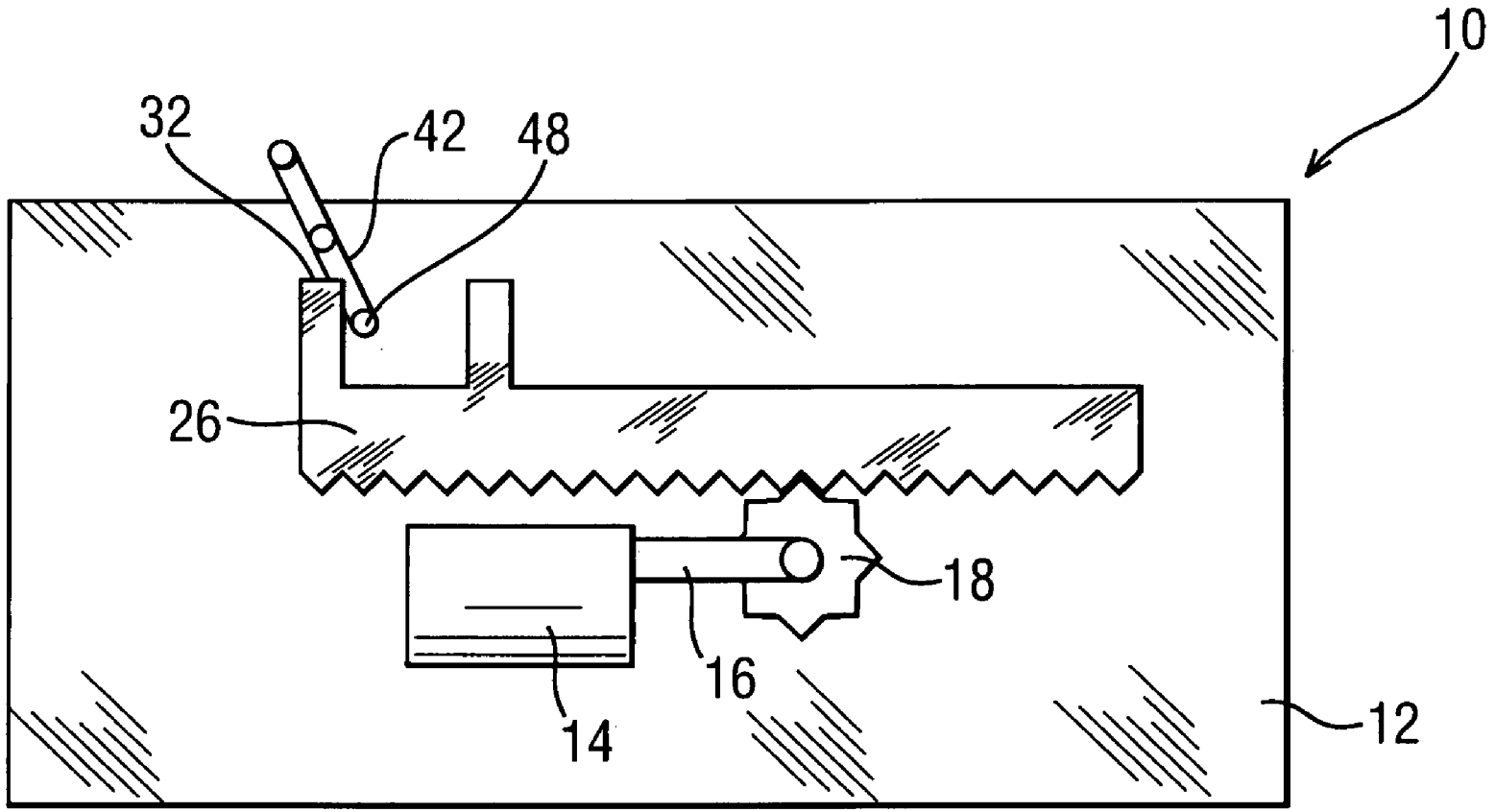
FIG. 5 is a schematic representation of the actuator of FIG. 4 where the actuator effects a second position in the displacement member to synchronize the displacement member with the output lever in the second output position before immediately returning to the rest position.

Immediately after the output lever 42 is manually moved from the first output position 46 (see FIG. 3) to the second output position 48 (see FIG. 4), the stepper motor 14 momentarily drives the displacement member 26 to a second position 32, shown in FIG. 5, before returning to the rest position 30, as shown in FIG. 1.

Once the output lever 42 has been manually moved to the position shown in FIG. 4, electrically moving the displacement member 26 to the position shown in FIG. 5 and then electrically returning it to the position shown in FIG. 4 (identical to the position shown in FIG. 1) appears, at face value, to be a redundant operation. However, the significance of this operation will become apparent when the actuator 10 is used in conjunction with other similar actuators, as described below.

The output lever 42 can also be manually moved from the second output position 48, shown in FIG. 1, to the first output position 46, shown in FIG. 3, in a similar manner by appropriate operation of the stepper motor 14.

Figure 6:
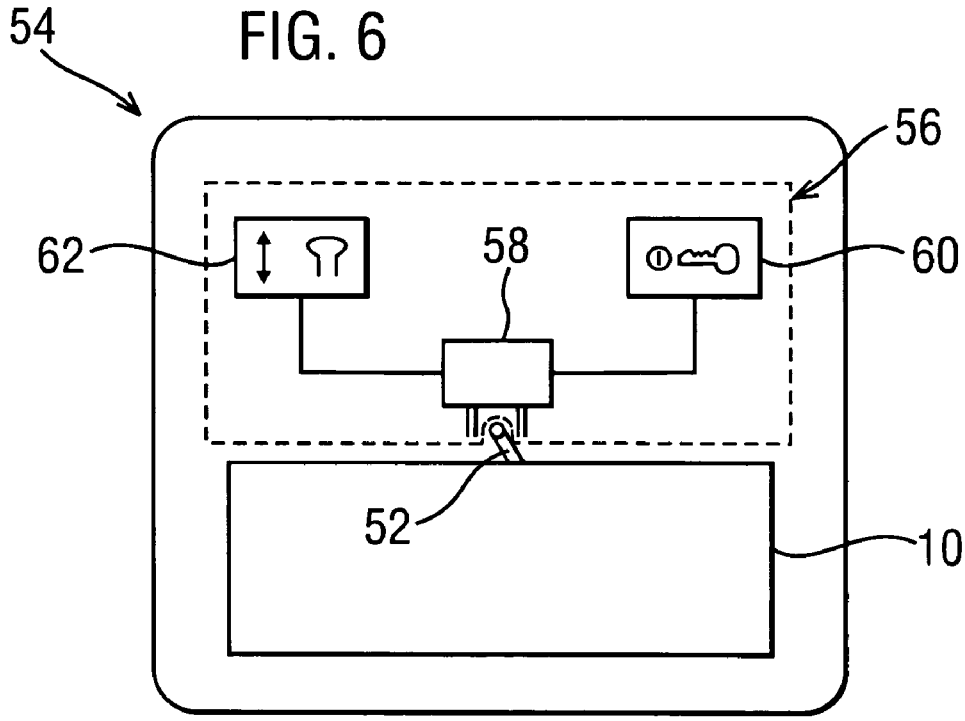
FIG. 6 is a schematic representation of a locking arrangement for a latch having the actuator of FIG. 1.

FIG. 6 shows a locking arrangement 54 for a latch having the actuator 10 of FIG. 1 and a locking system 56. The locking system 56 includes a lock/unlock mechanism 58, and a key barrel 60 and a sill button 62 both mechanically or electrically connected with the lock/unlock mechanism 58. The actuator 10 drives the lock/unlock mechanism 58 via an output arm 52.

The manual unlocking or locking of the latch is achieved by the operation of either the key barrel 60 or the sill button 62, which in turn displaces the output arm 52 of the output lever 42.

Conversely, the automated locking of the latch is achieved by the action of the stepper motor 14 driving the lock/unlock mechanism 58 via the output lever 42 and the displacement member 26.

Figure 6A:
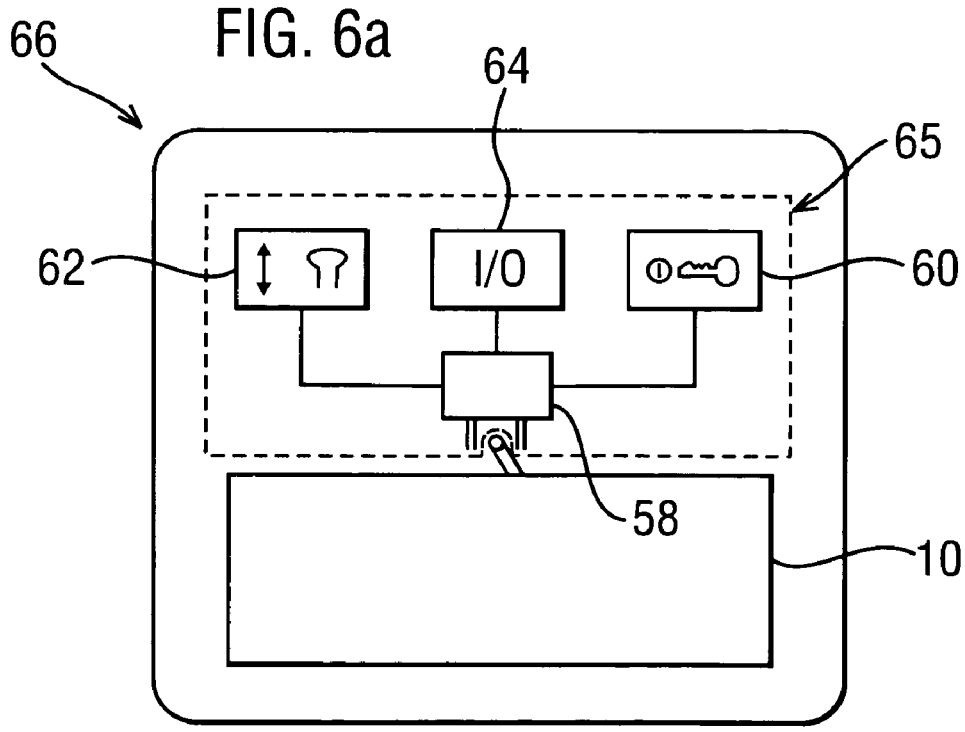
FIG. 6*a* is a schematic representation of a sensor locking arrangement including the locking arrangement of FIG. 6 having a latch status switch.

FIG. 6*a* shows a sensor locking arrangement 66, which is identical to the locking arrangement 54 except for the addition of a lock/unlock status switch 64 which detects the output position of the output lever 42 and provides a signal containing this information to a control (discussed further below). By knowing the position of the output lever 42, the control can be used to alter the position of the displacement member 26 of other associated locking arrangements to synchronize all the output levers 42, as will be described below.

Figure 7:
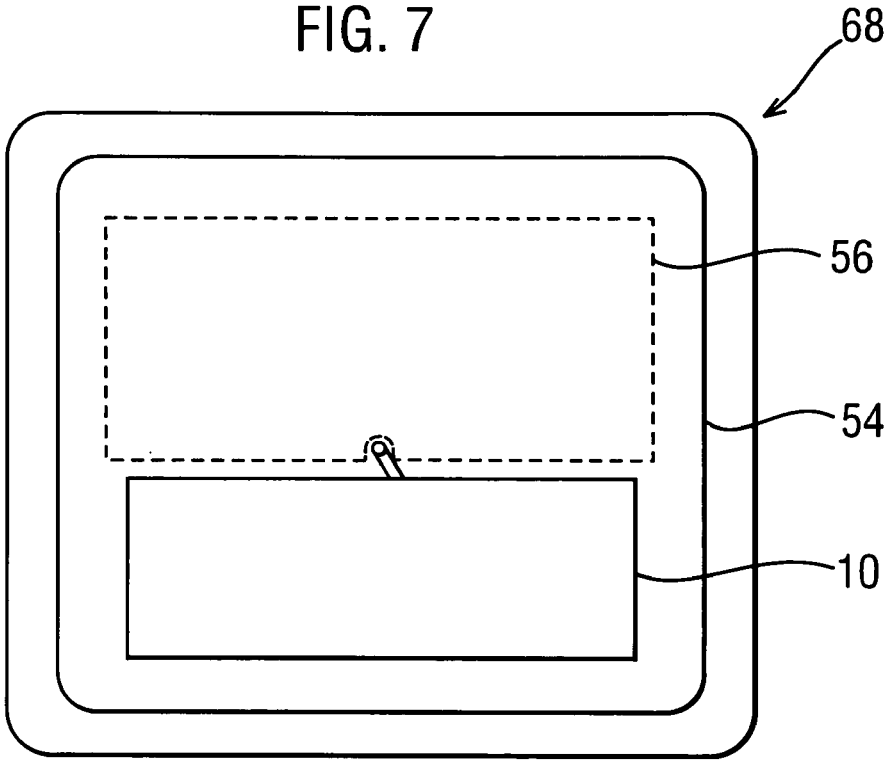
FIG. 7 is a schematic representation of a latch including the locking arrangement of FIG. 6.

In FIG. 7, a latch 68 includes the locking arrangement 54 of FIG. 6.

Figure 7A:
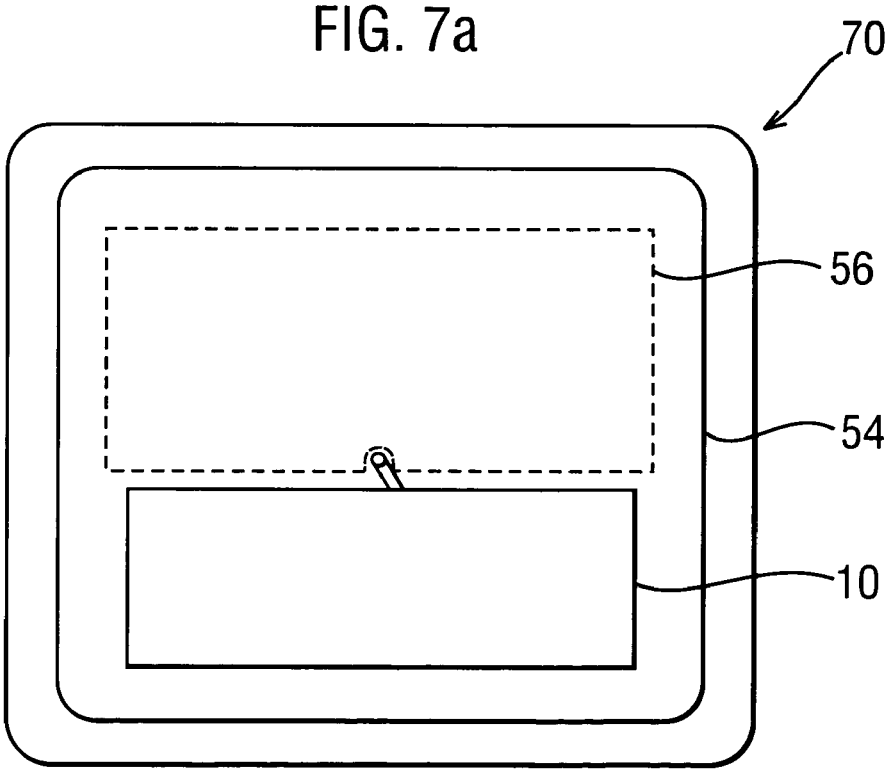
FIG. 7*a* is a schematic representation of a sensor latch including the sensor locking arrangement of FIG. 6*a;*

In FIG. 7*a*, a sensor latch 70 includes the sensor locking arrangement 66 of FIG. 6*a*, which includes the lock/unlock status switch 64.

Figure 8:
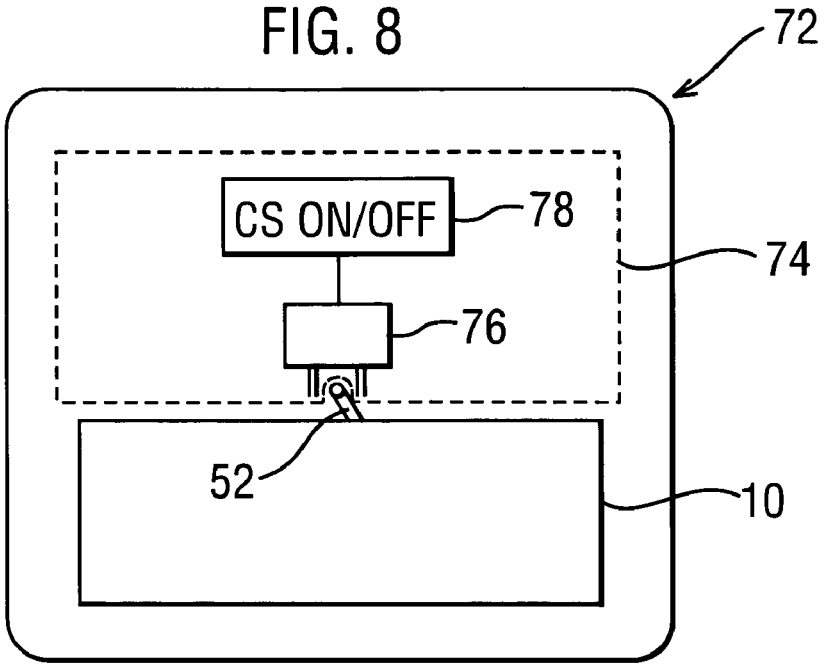
FIG. 8 is a schematic representation of a child safety arrangement including the actuator of FIG. 1.

FIG. 8 shows a child safety arrangement 72 for a latch having the actuator 10 of FIG. 1 and a child safety system 74. The child safety system 74 has a child safety on/off mechanism 76 and a child safety on/off toggle 78. The actuator 10 drives the child safety on/off mechanism 76 via the output arm 52. The manual switching of the child safety arrangement 72 between child safety "on" and child safety "off" is achieved by operating the child safety on/off toggle 78, which in turn displaces the output arm 52.

Conversely, the automatic switching of the child safety arrangement between child safety "on" and child safety "off" is achieved by the action of the stepper motor 14 that drives the child safety on/off mechanism 76 via the output lever 42 and the displacement member 26.

Figure 9:
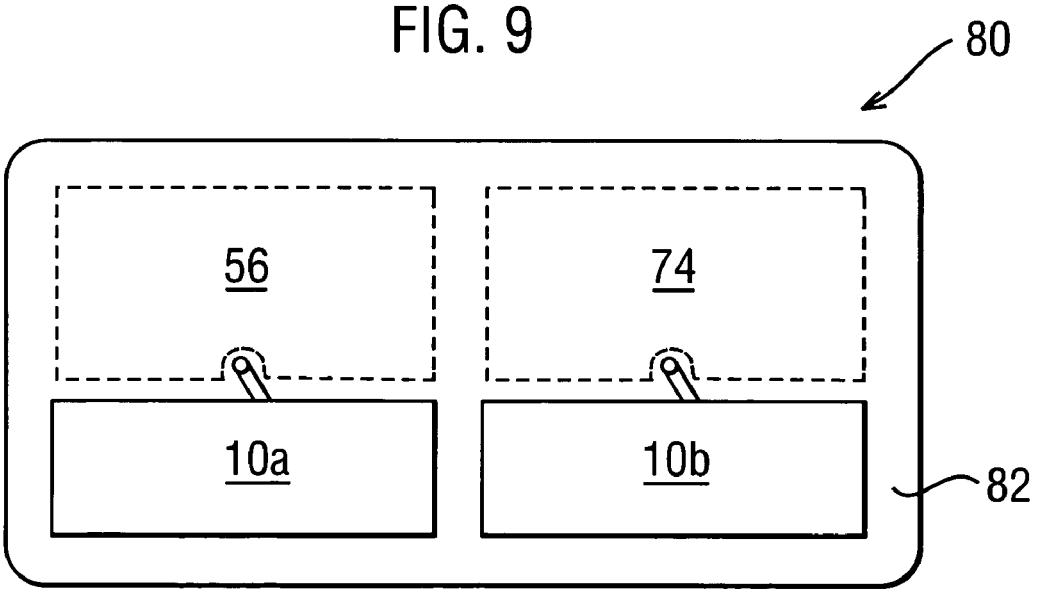
FIG. 9 is a schematic representation of a multifunction latch including the locking arrangement of FIG. 6 and the child safety arrangement of FIG. 8.

In FIG. 9, a multifunction latch 80 includes two actuators 10*a*, 10*b* each functionally identical to the actuator 10, a locking system 56 of FIG. 6, and a child safety system 74 of FIG. 8. The actuators 10*a* and 10*b*, the locking system 56 and the child safety system 74 are mounted on a multifunction latch body 82. The actuator 10*a* operates the locking system 56, and the actuator 10*b* operates the child safety system 74.

Figure 10:
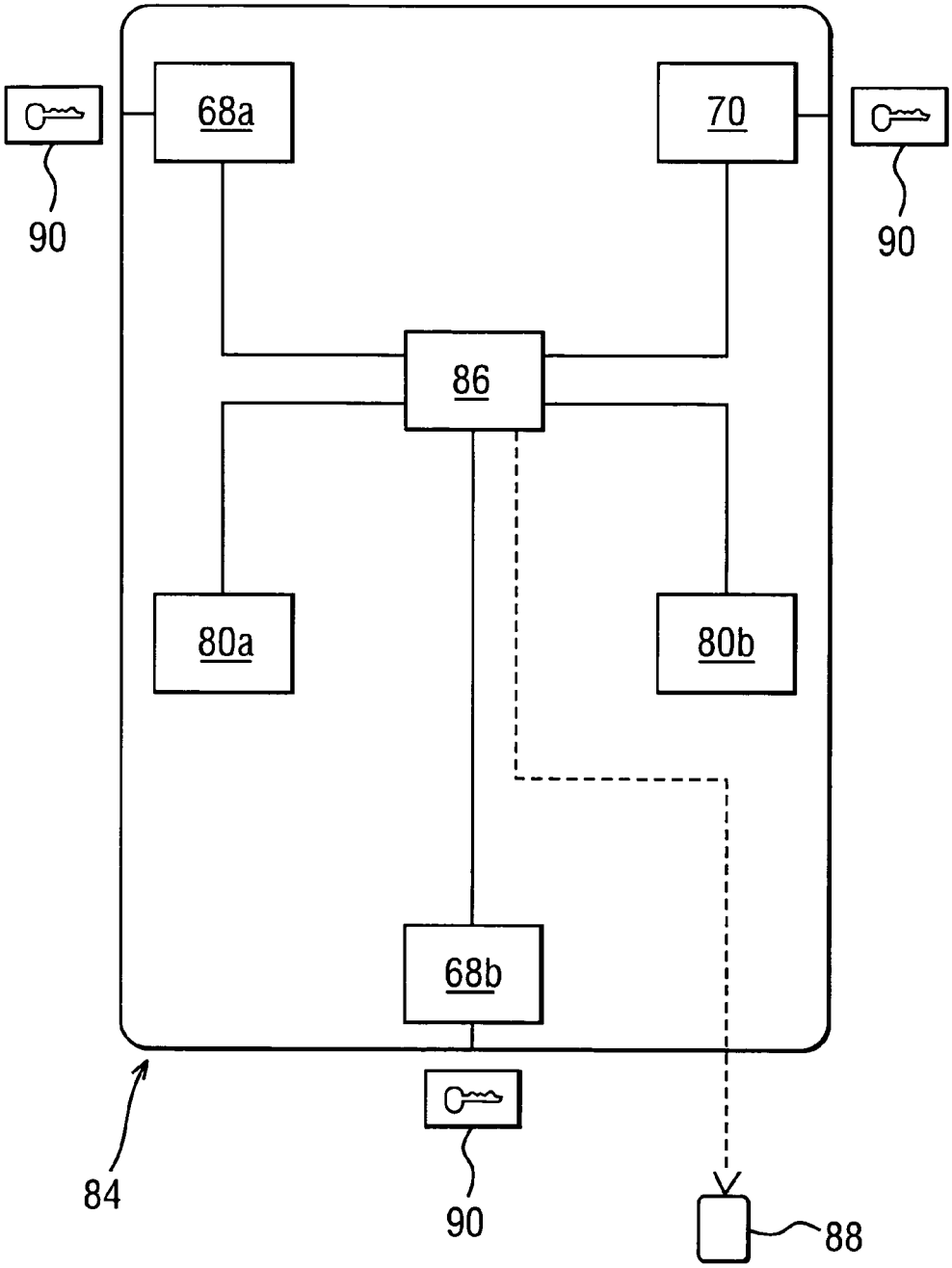
FIG. 10 is a schematic representation of a vehicle having a sensor latch of FIG. 7*a*, two latches of FIG. 7 and two multifunction latches of FIG. 9.

FIG. 10 shows a vehicle 84 having a sensor latch 70, a first latch 68*a* and a second latch 68*b* that are each identical to the latch 68, and a first multifunction latch 80*a* and a second multifunction latch 80*b* each identical to the multifunction latch 80.

The sensor latch 70 is mounted in the driver's door, the first latch 68*a* is mounted in the passenger door, the first and second multifunction latches 80*a* and 80*b* are located in the rear doors, and the second latch 68*b* is located in the boot or trunk lid of the vehicle. The latch status switch of the sensor latch 70 and the stepper motor 14 of each of the five latches 68*a*, 68*b*, 70, 80*a* and 80*b* are in communication with a common control 86. A remote locking device 88 remotely communicates with the common control 86. A key 90 engages with the key barrels 60 of the sensor latch 70, the first latch 68*a* and the second latch 68*b*.

In use, and by way of example only, all the latches 68*a*, 68*b*, 70, 80*a* and 80*b* have been centrally locked after the occupants leave the vehicle. Unlocking the first latch 68*a* using the key 90 manually unlocks the first latch 68*a* only. The subsequent manual actuation of the key 90 to unlock the sensor latch 70 would cause the latch status switch to instruct the common control 86 of the change in latch status. The common control 86 then communicates a signal to the stepper motors 14 of latches 68*a*, 68*b*, 70, 80*a* and 80*b* . The common control 86 then causes the stepper motors 14 of the latches 68*a*, 68*b*, 70, 80*a* and 80*b* to synchronize the output levers 42 of each of the five latches 68*a*, 68*b*, 70, 80*a* and 80*b* in the manner described above. The common control 86 then communicates a signal to the stepper motors 14 of each of the five latches 68*a*, 68*b*, 70, 80*a* and 80*b* to return the respective displacement members 26 to their rest positions. As a result, all the latches 68*a*, 68*b*, 70, 80*a* and 80*b* are in the correct status, and the stepper motors 14 of the latches 68*a*, 68*b*, 70, 80*a* and 80*b* all receive the same signal from the common control 86 despite the first latch 68*a* having an initial latch status different from the status of the other four latches 68*b*, 70, 80*a* and 80*b* . Further, the stepper motors 14 of each of the five latches 68*a*, 68*b*, 70, 80*a* and 80*b* has not been back driven, nor have they been required to stall.

The only latch having a sensor is the sensor latch 70 of the driver's door, which has a sensor to detect the manual unlocking of the door using a key barrel 60. None of the remaining four latches 68*a*, 68*b*, 80*a* and 80*b* require a sensor to determine whether the output lever 42 is in the first output position or the second output position. The initial position of the output lever 42 is irrelevant to the operation of the system. It therefore follows that the common control 86 is unaware of the position of the output lever 42 of the four latches 68*a*, 68*b*, 80*a* and 80*b* at any time except immediately after electric operation of the latches 68*a*, 68*b*, 80*a* and 80*b*.

With reference now to the second embodiment shown in FIGS. 11, 11*a*, 11*b*, 11*d*, and 12 to 16, a latch mechanism 110 includes a body 111 that supports various components of the latch mechanism 110.

The latch mechanism 110 further includes a claw 112 pivotally mounted about an axis 113 on the body 111. The claw 112 secures an associated door (not shown) in a closed position via a striker pin 114 attached to a door aperture. Rotation of the claw 112 in a counter-clockwise direction about the axis 113 when viewing FIG. 1 releases the striker pin 114, enabling opening of the associated door.

The claw 112 is held in a closed position by a pawl 115, only part of which is shown in dotted profile in FIG. 1 for clarity. The pawl 115 is pivotally mounted on the body 111 and can rotate about an axis 116. The claw 112 can be held in a first safety position (not shown) when the pawl 115 engages a first safety abutment 117 of the claw 112.

A pawl lifter 120 is generally flat and lies in a plane generally parallel to the pawl 115 to which it is rotationally secured. When viewing FIG. 1, the pawl 115 is obscured by the pawl lifter 120. Clearly, the pawl lifter 120 also rotates about the axis 116.

An inside lock link 121 and an outside lock link 122 are mounted for movement with the pawl 115 and are each individually pivoted about respective axes 121*a* and 122*a* on the pawl lifter 120. In this case, the inside lock link 121 and the outside lock link 122 are identical and each have respective cam followers 121*b* and 122*b* and release abutments 121*c* and 122*c*. The inside lock link 121 and the outside lock link 122 are each biased in a clockwise direction when viewing FIG. 1 such that the respective cam followers 121*b* and 122*b* contact a cam 130.

The cam 130 is rotatable independently from the pawl lifter 120 about the axis 116. The cam 130 has three cam lobes 131, 132, and 133 and two levers 134 and 135, shown diagrammatically throughout for clarity. The cam lobes 131, 132 and 133 and the levers 134 and 135 are all rotationally fast with the cam 130.

Figure 11:
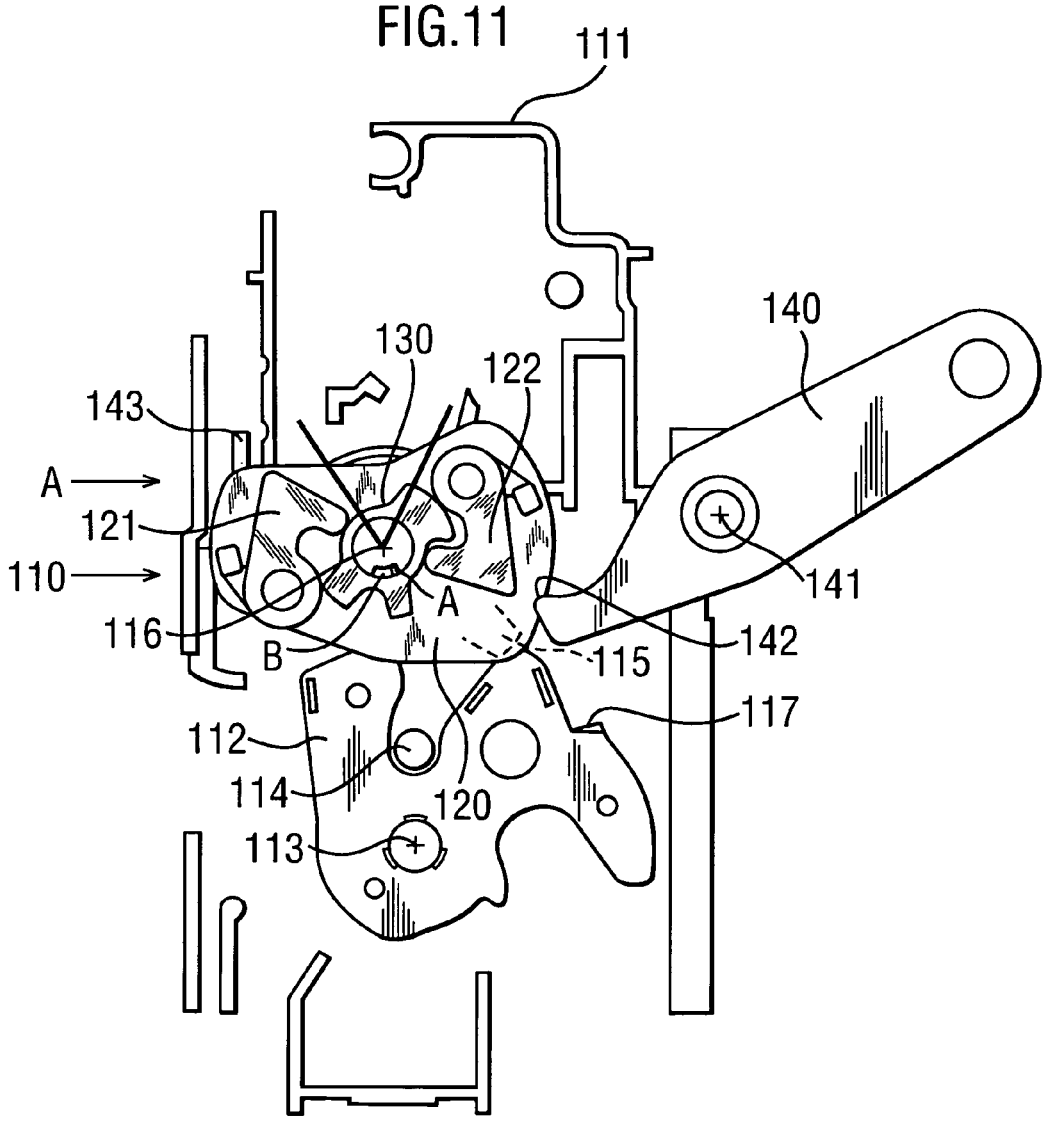
FIG. 11 is a latch mechanism according to a second embodiment of the present invention in a super-locked condition.
Figure 11A:
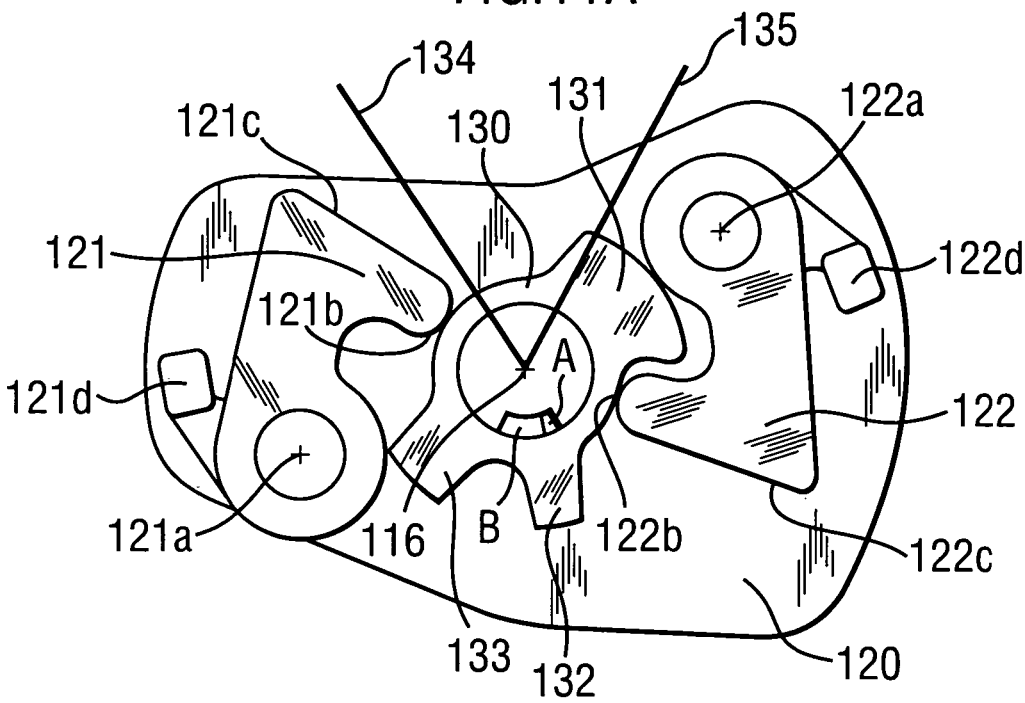
FIG. 11*a* is an enlarged view of part of FIG. 11.
Figure 11B:
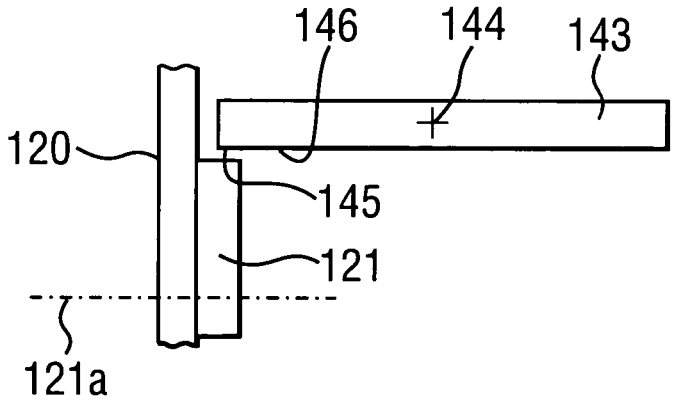
FIG. 11*b* is a schematic view in the direction of arrow A of FIG. 11.
Figure 11C:
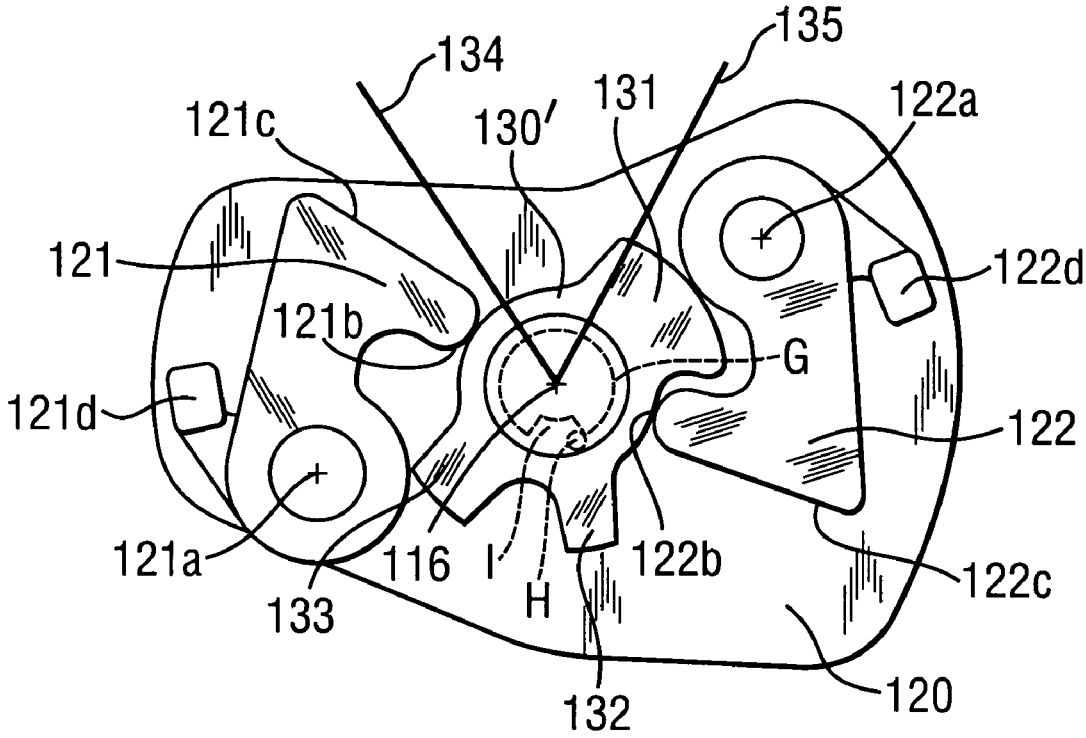
FIG. 11*c* is an enlarged view of a latch mechanism according to a third embodiment of the present invention similar to that of FIG. 11*a* and in a superlocked condition.
Figure 11D:
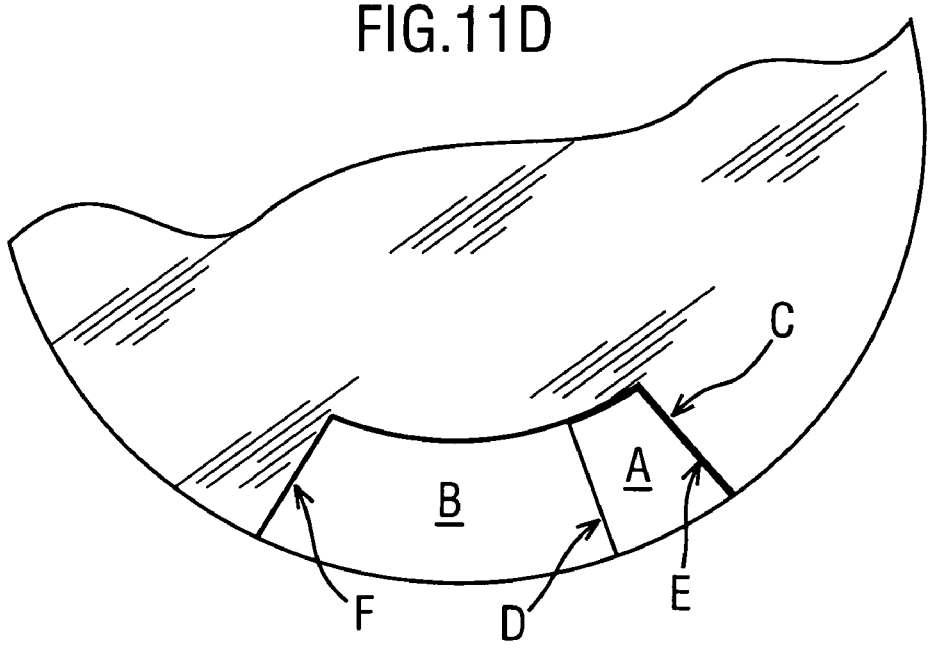
FIG. 11*d* is an enlarged view of part of FIG. 11.

As shown in FIG. 11*d*, the cam 130 includes a slot B in which operates a pin A. The pin A is in rotational engagement with a stepper motor (not shown for clarity) and has a first driving surface C and a second driving surface D for respective engagement with a first driven surface E and a second driven surface F of the cam 130. The stepper motor drives the cam 130 via the lost motion of the slot B.

The outside release lever 140 is pivotally mounted about an axis 141. The inside release lever 143 (shown diagrammatically in FIG. 1*b*) is pivotally mounted about the axis 144.

Figure 12:
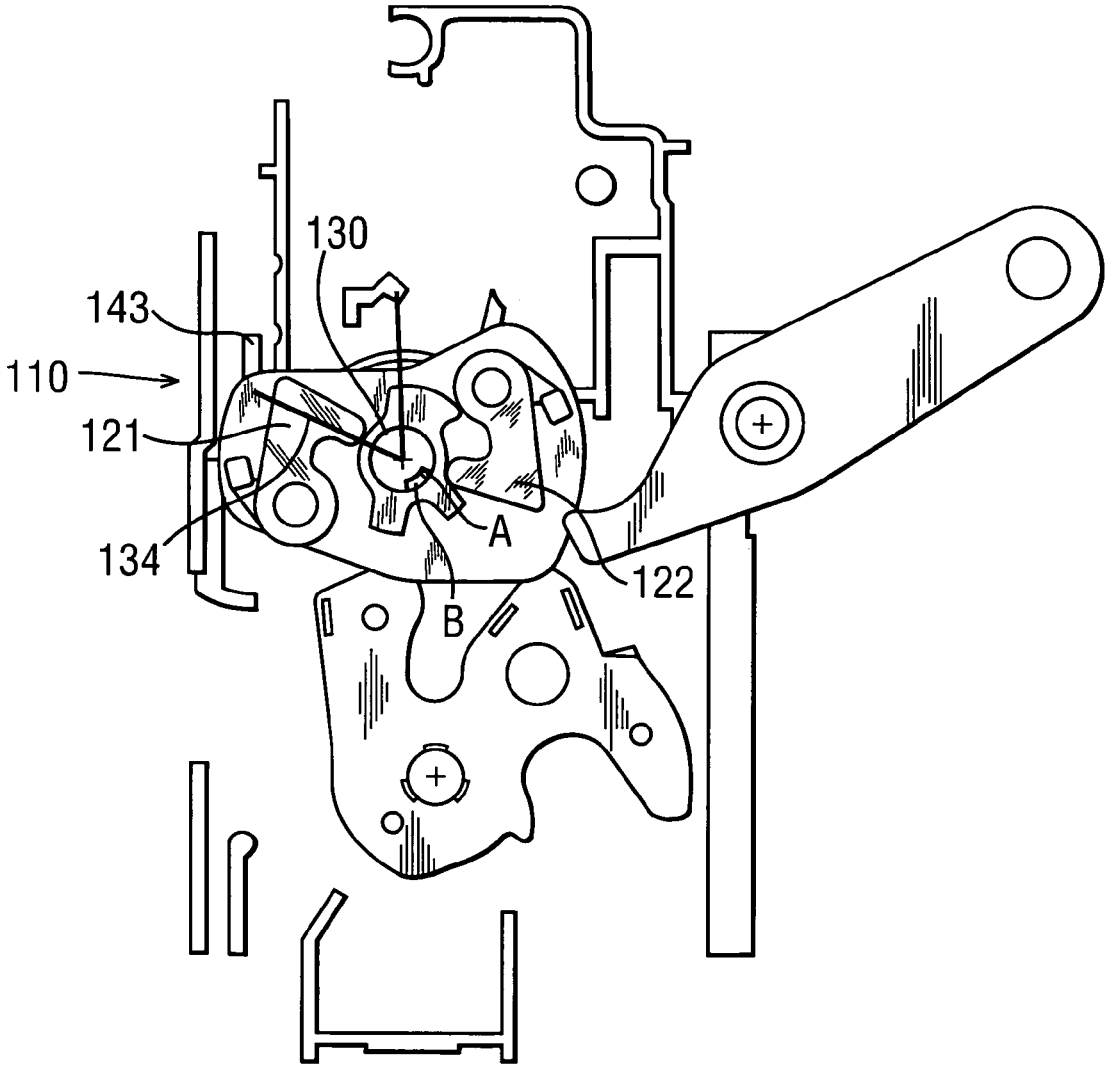
Figure 13:
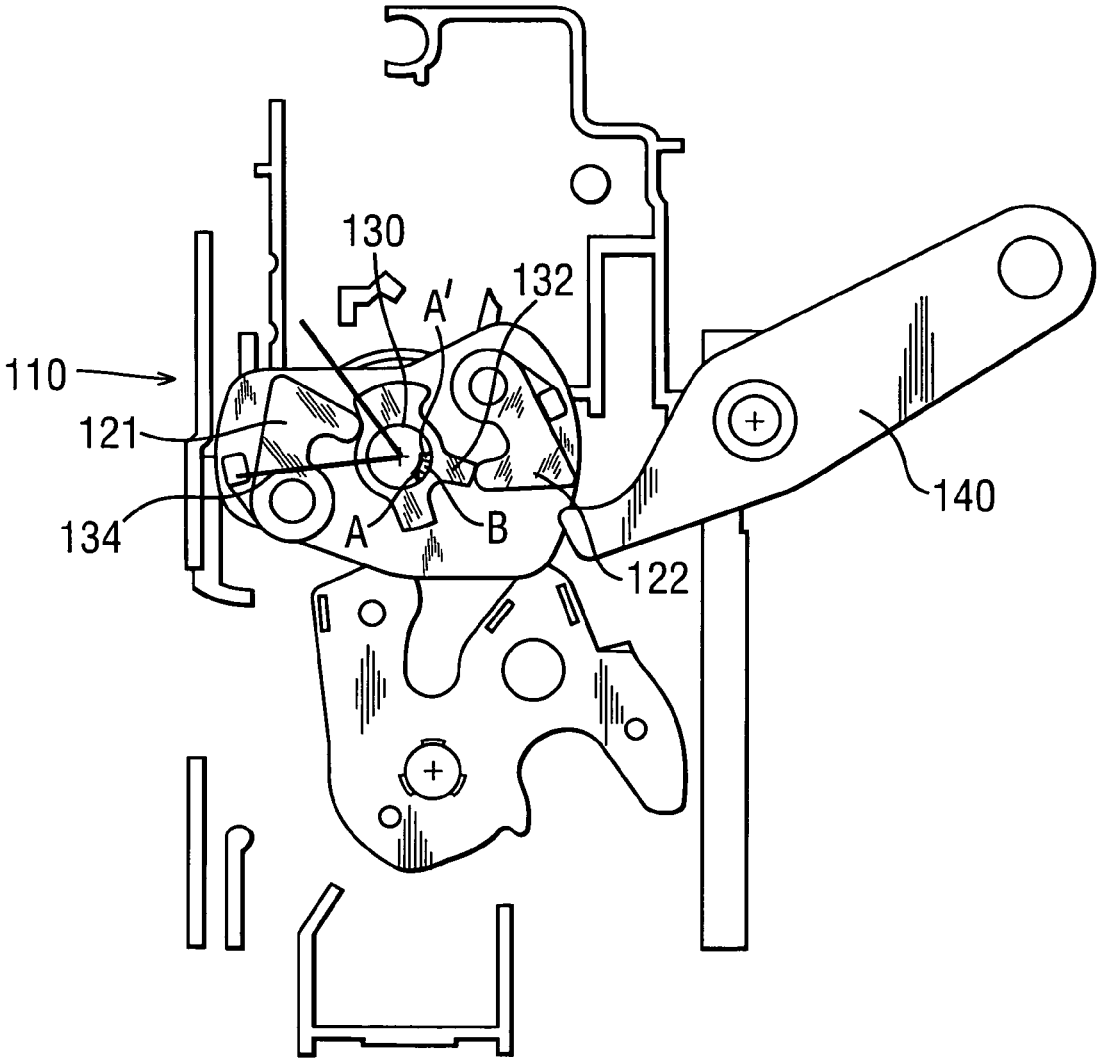
Figure 13A:
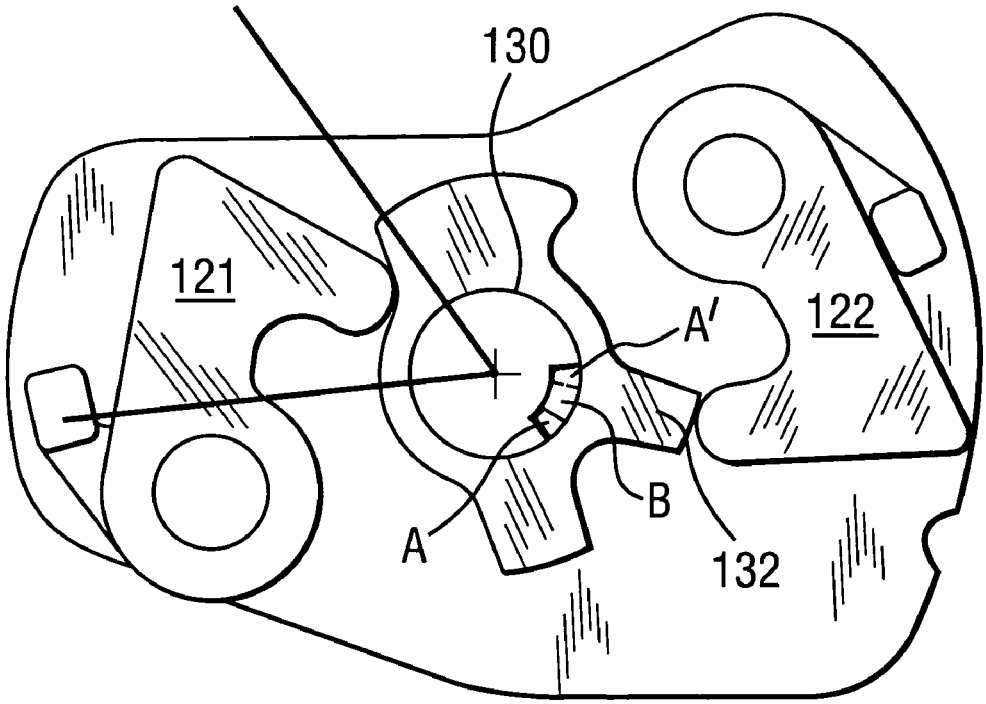
FIG. 13*a* is an enlarged view of FIG. 13.

Operation of a door latch mechanism is as follows. FIG. 12 shows the door latch mechanism 110 in a locked position with the child safety feature on. The lever 134 is in a position such that operation of the inside release lever 143 in a counter-clockwise direction when viewing FIG. 11 causes the abutment 146 to contact the lever 134 and rotate the cam 130 to the position shown in FIG. 13. This operation constitutes the manual operation of the latch mechanism 110. However, the latch status may be changed from locked child safety on, as depicted in FIG. 12, to unlocked child safety on, as depicted in FIG. 13, by the electric operation of the stepper motor as follows. In FIG. 12, the cam 130 is shown in the first output position, while the pin A is shown in a rest position. Actuation of the stepper motor causes the first driving surface C of the pin A to engage with the first driven surface E of the slot B. Thus, the movement of the cam 130 to the second position shown in FIGS. 13 and 13*a* is caused by the movement of the pin A to the second position A' (shown chain dotted in FIG. 13*a*) before the pin A returns to the rest position (FIG. 13*a*). The initial manual or electric operation of the inside release lever 143 does not unlatch the latch mechanism 110, but only operates to unlock the door (see below). This method of overriding and opening a locked door that has the child safety on is especially important in an emergency situation whereby a passer-by can access the inside release lever 143 (e.g., by breaking the door window glass), operate the inside release lever 143 to unlock the door, then operate the outside release lever 140 to open the door and then remove a child from the car.

The lever 134 is only operable by the inside release lever 143 in one direction. The inside release lever 143 moves the lever 134 from the locked child safety on position shown in FIG. 12 to the unlocked child safety on position shown in FIG. 13. However, it is not possible to reverse this operation and consequently it is not possible to manually alter the status of the latch mechanism 110 from unlocked child safety on, as shown in FIG. 13, to locked child safety on, as shown in FIG. 12. It is, however, still possible to electrically alter the latch mechanism 110 from an unlocked child safety on status to a locked child safety on status by operation of the stepper motor. In this operation, the pin A is driven to a first position, causing the cam 130 to return to the first position (FIG. 11) before being returned through the lost motion slot B to the rest position.

FIG. 13 shows the door latch mechanism 110 in an unlocked condition with the child safety feature on. The cam 130 has been rotated sufficiently (either by operating the inside release lever 143 when the cam 130 is in the position shown in FIG. 12 or by independent rotation of the cam 130 directly, e.g., by a power actuator), such that the cam follower 122*b* has ridden up the cam lobe 132, resulting in counter-clockwise rotation of the outside lock link 122. Thus, when the outside release lever 140 is operated, the abutment 142 contacts the release abutment 122*c*, causing the pawl lifter 120 as a whole to rotate counter-clockwise when viewing FIG. 13, releasing the pawl 115 and allowing the claw 112 to open. A stop 122*d* limits the counter-clockwise rotation of the outside lock link 122. Upon release of the outside release lever 140, the pawl lifter 120 is biased back to the position as shown in FIG. 13 by a spring (not shown). The inside lock link 121 is in the position where operation of the inside release lever 143 does not allow the door to open.

Figure 14:
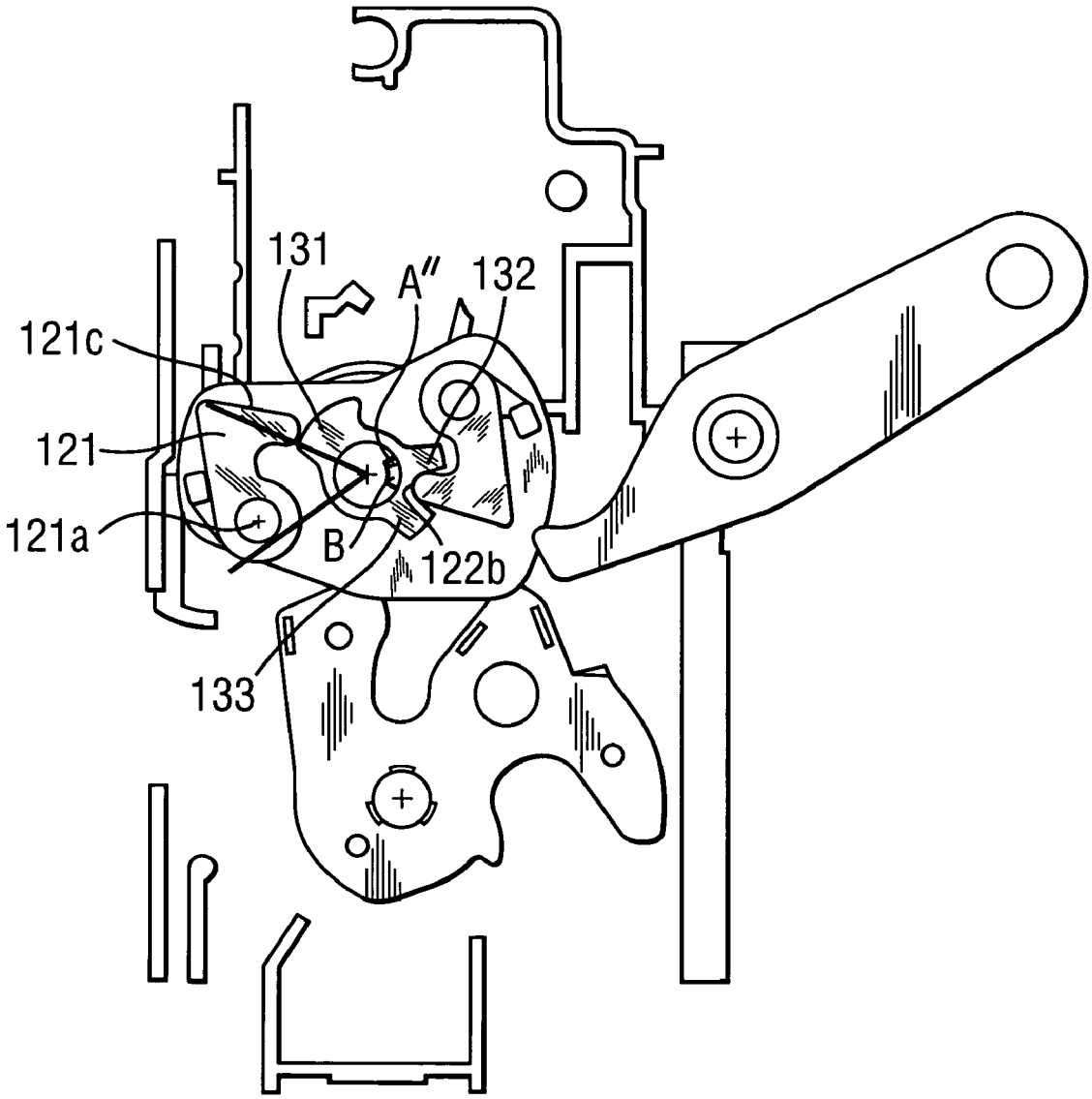
FIG. 14 is the latch mechanism of FIG. 11 in a locked condition with the child safety off.

FIG. 14 shows the door latch mechanism 110 in a locked condition with the child safety feature off. The pin A has moved from the rest position, as shown in FIG. 13, to a further rest position A", best shown in FIG. 14*a*. This change in status may only be achieved electrically since it is not possible to manually back drive the stepper motor to move the pin A from the position in FIG. 13 to that in FIG. 14. In other words, it is not possible to manually alter the status of the latch mechanism 110 from child safety "on" to child safety "off" and likewise from child safety "off" to child safety "on" The cam follower 122*b* is situated between the cam lobes 132 and 133, thus ensuring that operation of the outside release lever 140 does not release the latch mechanism 110. Furthermore, the rotation of the cam 130 causes the cam follower 121*b* to ride up the cam lobe 131, causing the inside lock link 121 to rotate counter-clockwise about the axis 121*a*. Thus, the release abutment 121*c* of the inside lock link 121 is contacted by the abutment 145 of the inside release lever 143 when it is operated. This causes counter-clockwise rotation of the pawl lifter 120 about the axis 116, resulting in unlatching of the door mechanism and allowing the door to be subsequently opened. The stop 121*d* limits the counter-clockwise rotation of the inside lock link 121. The operation of the inside release lever 143 also causes the abutment 146 to contact the lever 135, causing rotation of the cam 130 to the position shown in FIG. 5. This prevents a vehicle occupant from inadvertently locking himself out of the vehicle since opening of the door from the inside automatically unlocks the door, allowing subsequent opening from the outside.

Figure 14A:
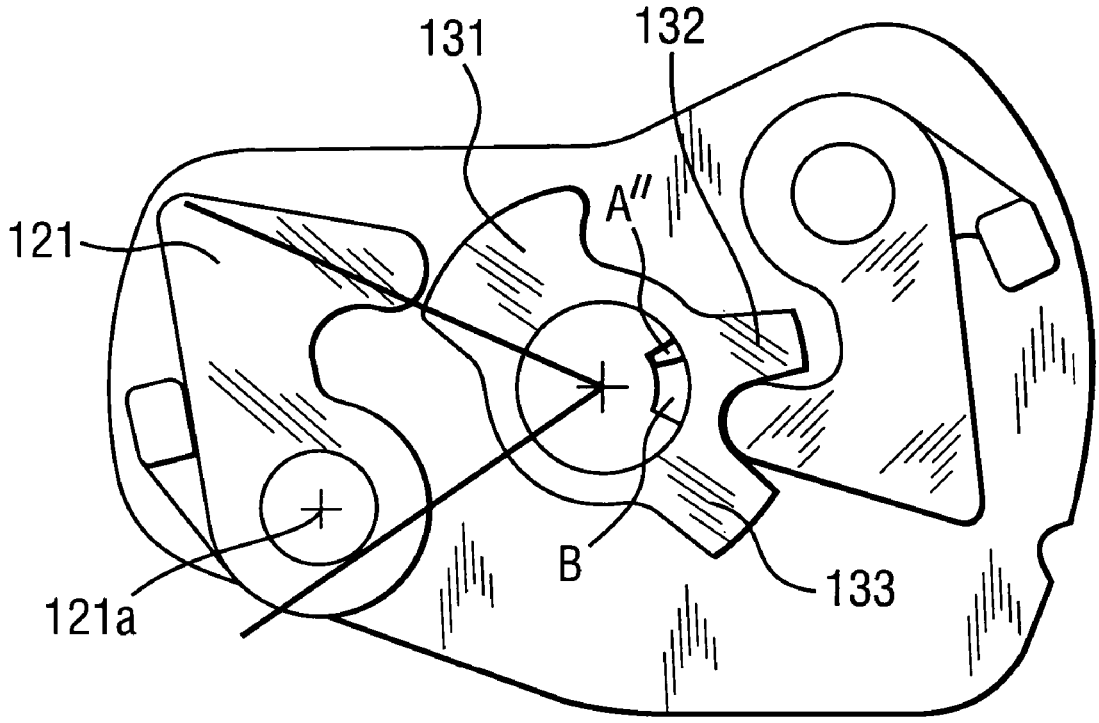
FIG. 14*a* is an enlarged view of FIG. 14.
Figure 15:
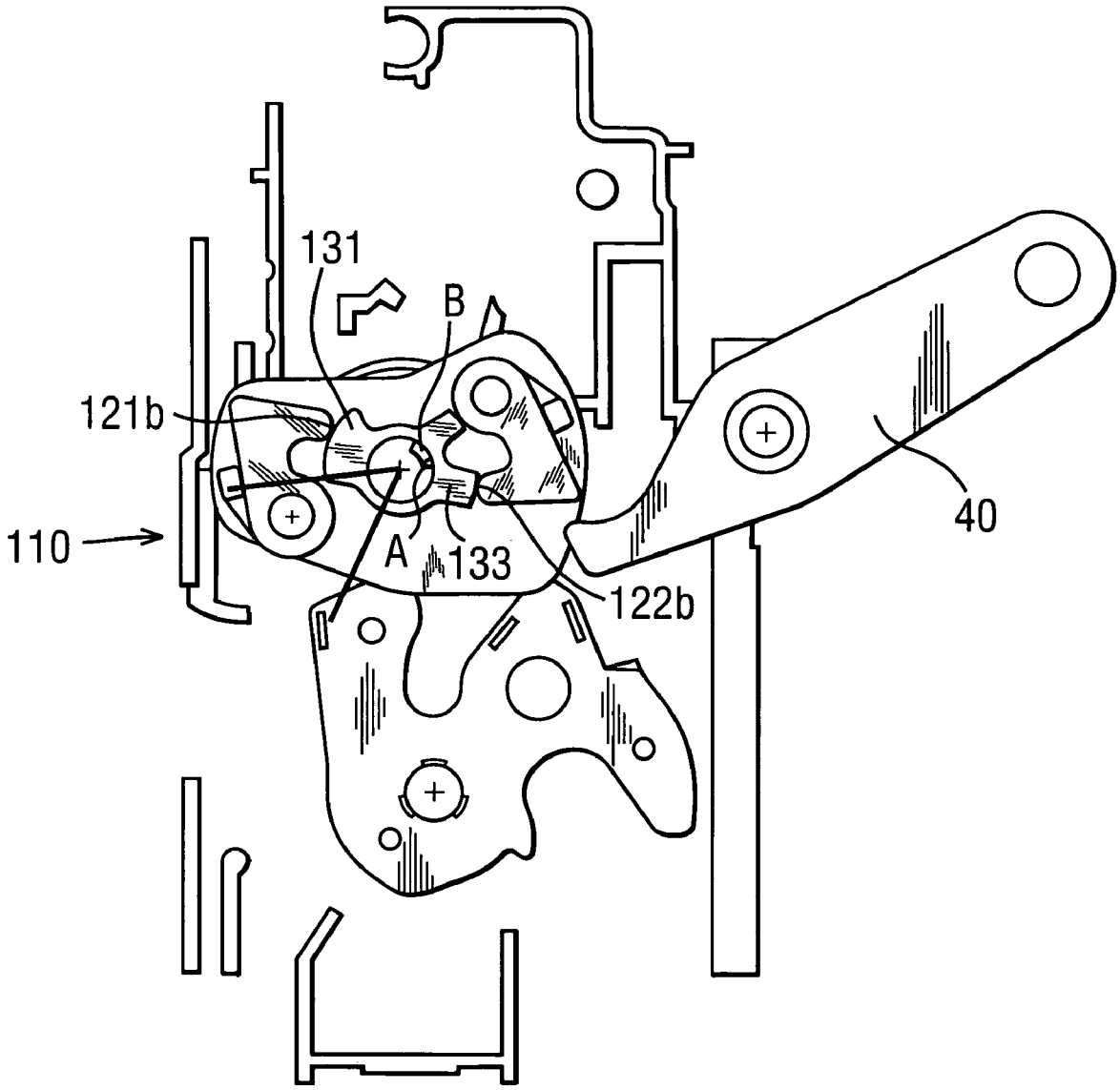
FIG. 15 is the latch mechanism of FIG. 11 in an unlocked position with the child safety off.
Figure 15A:
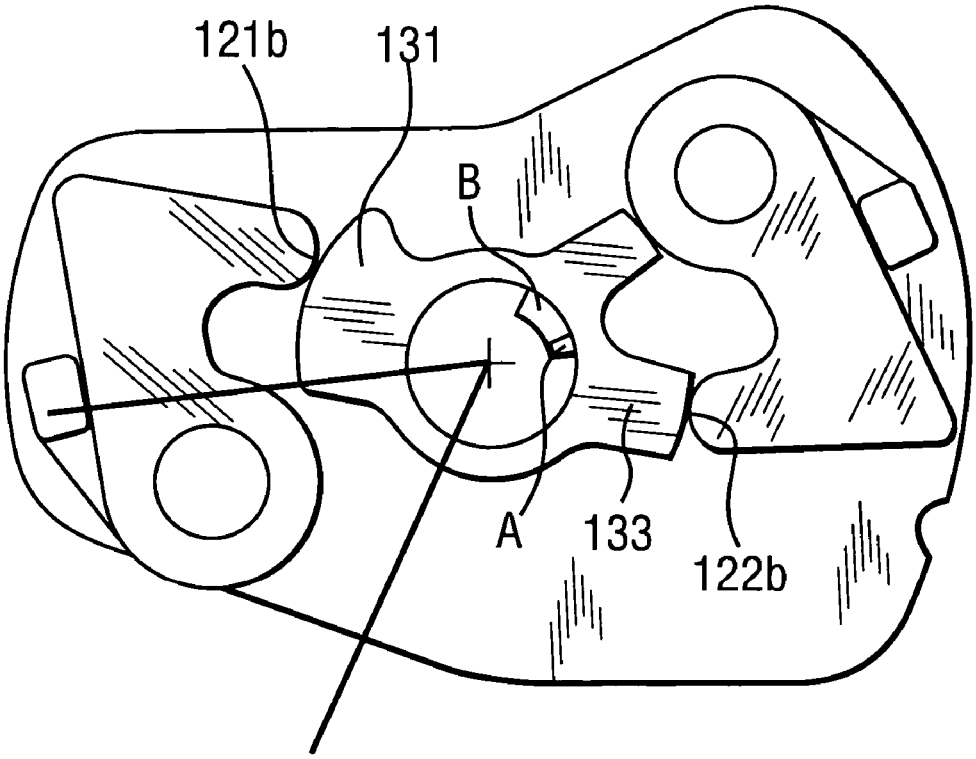
FIG. 15*a* is an enlarged view of FIG. 15.

The operation of the latch mechanism 110 between the unlocked child safety off position to the locked child safety off position is similar to the operation that changes the status of the latch mechanism 110 between locked child safety on to unlocked child safety on. To electrically move the cam 130 from the position shown in FIG. 14 to that shown in FIG. 15, the stepper motor drives the pin A from the further rest position (as depicted in FIGS. 14*a* and 15*a*) to a fourth position which in turn drives the cam 130 to the fourth position. The stepper motor then returns the pin A to the further rest position. Likewise, the cam 130 can be moved from the fourth position, as shown in FIG. 15, to the third position, as shown in FIG. 14, by operation of the pin A from the further rest position to the third position followed by its return to the further rest position. Just as it is not possible to manually alter the latch from an unlocked child safety on status (FIG. 13) to a locked child safety on status (FIG. 12) as discussed above, it is not possible to manually change the latch from the unlocked child safety off status (FIG. 15) to the locked child safety off status (FIG. 14) since the inside release lever 143 is unable to act on the lever 135 when the lever 135 is in the position shown in FIG. 15.

FIG. 15 shows the door latch mechanism 110 in an unlocked position with the child safety feature off. The cam 130 has been rotated (either by operating the inside release lever 143 when the cam 130 was in the position shown in FIG. 4 or by independent rotation of the cam 130 directly, e.g., by a power actuator) such that the abutment 21*b* now rests on the cam lobe 133, allowing operation of the outside release lever 140 to unlatch the latch mechanism 110 as described above. Furthermore, the abutment 21*b* remains in contact with the cam lobe 31, ensuring that operation of the inside release lever 143 also unlatches the door latch mechanism 110.

Figure 16:
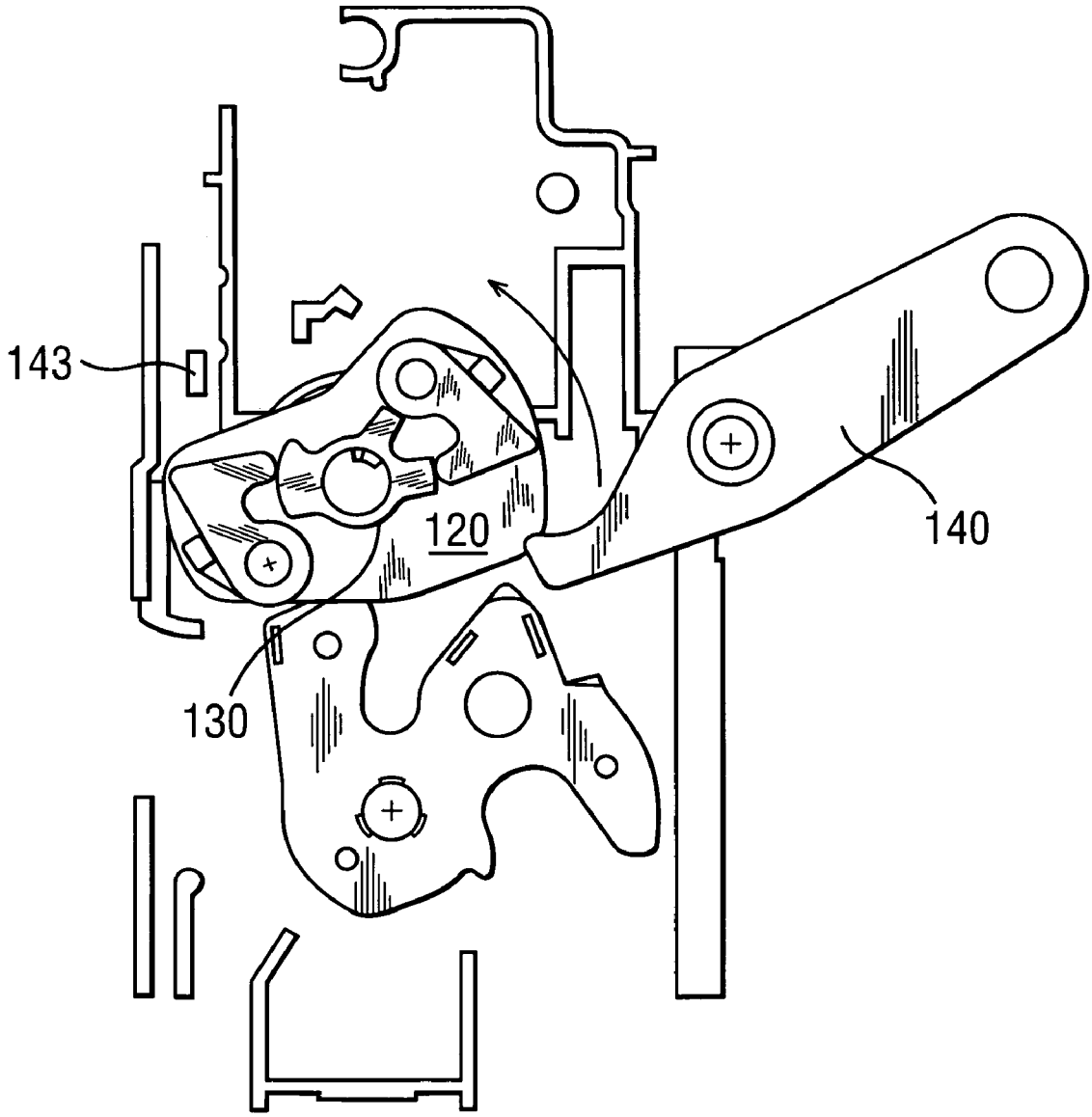
FIG. 16 is a latch mechanism of FIG. 11 in a release position.

FIG. 16 shows the door latch mechanism 110 in a released position. This position is achieved by rotating the cam 130 in a counter-clockwise direction, allowing contact between corresponding lost motion abutments (not shown) on the pawl lifter 120 and the cam 130. The lost motion abutments allow the cam 130 to rotate the pawl lifter 120 to release the door latch mechanism 110 independently of the operation of the outside release lever 140 or the inside release lever 143. Only a single cam is required to effect the various modes of operation.

FIG. 11*c* shows a third embodiment of the present invention which is similar to the second embodiment shown in FIG. 11*a*. Where the second embodiment has the pin A that cooperates with the slot B of the cam 130, the third embodiment has a lug H fixably attached to the cam 130' and a drive cam G rotationally mounted about the axis 116 and in rotational driven engagement with the stepper motor. The drive cam G has a waisted portion I to provide lost motion between the drive cam G and the lug H. The operation of the drive cam G and lug H is similar to that of the pin A and the slot B of the second embodiment in that the drive cam G has a first driving surface for engagement with a first driven surface of the lug D and a second driving surface for engagement with a second driven surface of the lug D.

Figure 17:
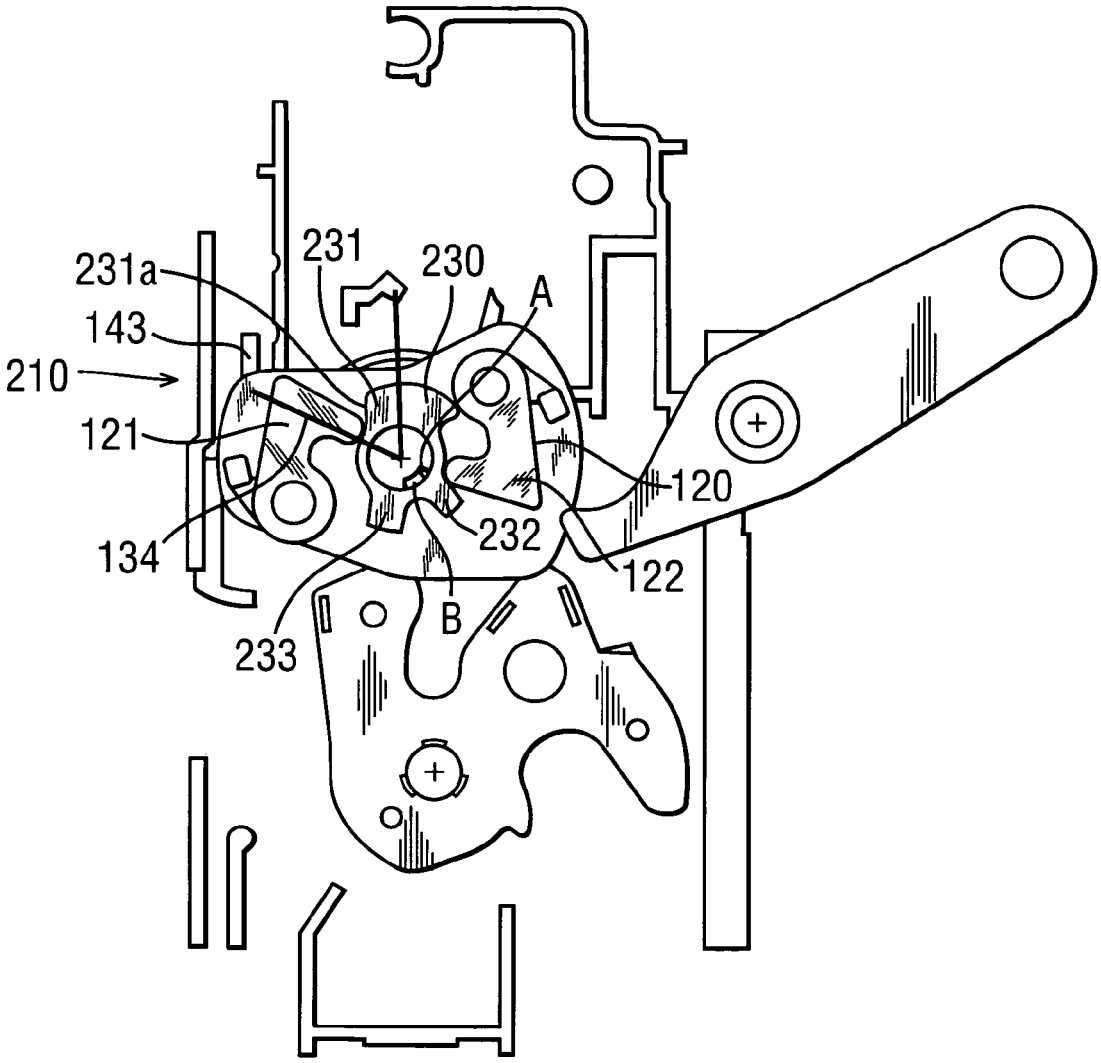
FIG. 17 is a latch mechanism according to a third embodiment of the present invention in a locked condition.

With reference to FIG. 17, a latch mechanism 210 is similar to the latch mechanism 110 shown in FIGS. 11 to 16. The latch mechanism 210 differs from the latch mechanism 110 in that the cam 230 has a different profile to the cam 130 of the latch mechanism 110. Cam lobes 232 and 233 of the cam 230 are identical to the cam lobes 132 and 133 of the cam 130 of the latch mechanism 110. However, the profile of the cam lobe 231 is different to that of the cam lobe 131. In particular, a front face 231*a* of the cam lobe 231 extends rotationally further towards the cam lobe 233 than the cam lobe 131 extends towards the cam lobe 133.

The effect of this altered cam profile in use is as follows. In FIG. 17, the latch mechanism 210 is in a locked condition. Operation of inside release lever 143 causes the cam 230 to rotate because of operation of the lever 134. As the cam 230 rotates, the front face 231*a* of the cam lobe 231 engages the inside lock link 121 and moves the inside lock link 121 into the path of the inside release lever 143. Subsequent operation of the inside release lever 143 rotates the pawl lifter 120, which will release the claw 112 and the associated striker pin (not shown for clarity).

The latch mechanism 110 in FIG. 12 is in a locked child safety on condition (operation of the inside release lever 143 does not move the inside link lever 121), and the latch mechanism 210 in FIG. 17 is in a locked, but not child safety on, condition. The purpose of the latch mechanism 210 is to provide a latch mechanism which, like the latch mechanism 110, has a cam 230 that can achieve four positions.

Conceptually, both the latch mechanism 110 and the latch mechanism 210 can be considered to have two latch status sets, each latch status set including two output positions of the cams 130 and 230.

In the latch mechanism 110, a first latch status set corresponds to a child safety on status, with the first cam position and the second cam position associated with the first latch status set and corresponding to a locked (child safety on) condition and an unlocked (child safety on) condition of the latch mechanism 110, respectively. A second latch status set corresponds to a child safety off status of the latch mechanism 110 with the third position and the fourth position of the cam 130 corresponding to a locked (child safety off) condition and an unlocked (child safety off) condition of the latch mechanism 110, respectively.

Like the latch mechanism 110, the latch mechanism 210 has two latch status sets. However, both the first latch status set and the second latch status set correspond to a child safety off status in the latch mechanism 210. In other words, none of the four positions of the cam 230 (of which one is shown in FIG. 17) correspond to child safety on. The latch mechanism 210 can therefore be installed in a front door of a vehicle where it is not desirable to achieve a child safety on latch status.

The advantage of the latch mechanism 210 is that with only minor alterations to the design of the cam 230, front and rear door latches can be manufactured which share a vast majority of components. There are also advantages in terms of controlling a system containing a latch mechanism 110 and 210 as will be considered shortly.

Figure 18:
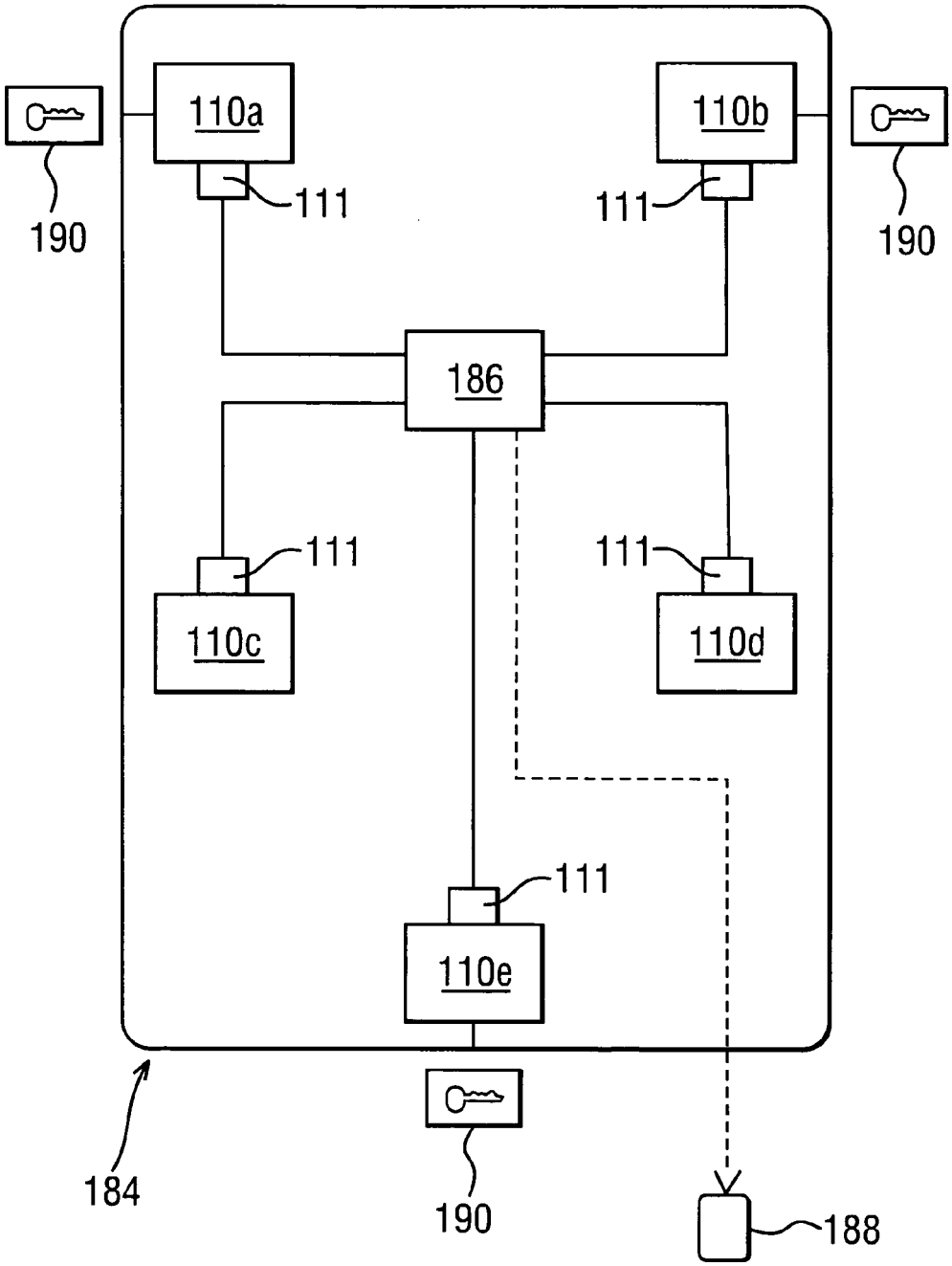
FIG. 18 is a schematic representation of a vehicle having five latch mechanisms.

FIG. 18 shows a vehicle 184 similar to the vehicle 84 shown in FIG. 10. The vehicle 184 has five latch mechanisms 110*a*, 110*b*, 110*c*, 110*d* and 110*e*, each identical to latch mechanism 110. The latch mechanism 110*a* is mounted in the driver's door, the latch mechanism 110*b* is mounted in the front passenger door, the latch mechanisms 110*c* and 110*d* are mounted in the rear doors, and the latch mechanism 110*e* is mounted in the trunk lid. The latch mechanisms 110*a* and 110*b* in the front door and the latch mechanism 110*e* in the trunk lid are lockable/unlockable by a key 190. Each of the latch mechanisms 110*a*, 110*b*, 110*c*, 110*d* and 110*e* are in communication with a common control 186 and are each provided with a latch status switch 118. The latch mechanisms 110*a*, 110*b*, 110*c*, 110*d* and 110*e* are operable via the common control 186, which is operable by a remote key fob 188.

A summary of the operation of each of the latch mechanisms 110 is shown in the following table:

LATCH MECHANISM 110

| Status Set | Latch Condition | Output Position | Fig No | Latch Status |
|---|---|---|---|---|
| 1st | 1st (locked) | 1 | 12 | 1st (locked Child Safety on) |
| 1st | 2nd (unlocked) | 2 | 13 | 2nd (unlocked Child Safety on) |
| 2nd | 1st (locked) | 3 | 14 | 3rd (locked Child Safety off) |
| 2nd | 2nd (unlocked) | 4 | 15 | 4th (unlocked Child Safety off) |

In use, and by way of example only, assume all the latch mechanisms 110*a*, 10*b*, 110*c*, 110*d* and 110*e* have been centrally locked after the occupants have left the vehicle. The latch mechanisms 110*c* and 110*d* in the rear doors are in a child safety on status (output position 1), and the latch mechanisms 110*a* and 110*b* of the front doors are necessarily in a child safety off status (output position 3). All of the latch mechanisms 110*a*, 110*b*, 110*c*, 110*d* and 110*e* are in a locked condition, the latch mechanisms 110*a* and 110*b* of the front doors are within the second status set (child safety off), and the latch mechanisms 110*c* and 110*d* of the rear doors are within the first status set (child safety on). Unlocking the door latch mechanism 110*b* of the front passenger door using the key 190 manually unlocks only the latch mechanism 110*b* (output position 4). The subsequent manual actuation of the key 190 to unlock the latch mechanism 110*a* of the driver's door causes the associated latch status switch 118 to instruct the common control 186 of a change in latch status in the driver's door within the second status set, i.e., the driver's door has changed from output position 3 to output position 4, both of which are in the second status set. The common control 186 then communicates a signal to the stepper motors of the latches 110*b*, 110*c*, 110*d* and 110*e* to synchronize the condition of the respective latches within their respective status set accordingly.

Upon subsequent electric locking of the door by the remote key fob 188, each of the latch mechanisms 110*a*, 110*b*, 110*c*, 110*d* and 110*e* are driven by the respective stepper motor to the locked condition within the respective status set.

A summary of the operation of such a system is summarized in the following table, which shows the output positions during the above sequence of events. (Note that the last two columns show how each stepper motor powers each output of each of the latch mechanisms 110*a*, 110*b*, 110*c*, 110*d* and 110*e*).

| Latch Mechanism | All latches locked | 110b manually unlocked | 110a manually unlocked | Key fob electric lock |
|---|---|---|---|---|
| 110a | 3 | 3 | 3 »4 | 4 »3 |
| 110b | 3 | 4 | 4 »4 | 4 »3 |
| 110c | 1 | 1 | 1 »2 | 2 »1 |
| 110d | 1 | 1 | 1 »2 | 2 »1 |
| 110e | 3 | 3 | 3 »4 | 4 »3 |

Similarly, the system can be operated as follows when the vehicle is left in an unlocked condition with the rear doors in a child safety off status.

| Latch Mechanism | All latches locked | 110b manually unlocked | 110a manually unlocked | key fob electric lock |
|---|---|---|---|---|
| 110a | 3 | 3 | 3 »4 | 4 »3 |
| 110b | 3 | 4 | 4 »4 | 4 »3 |
| 110c | 3 | 3 | 3 »4 | 4 »3 |
| 110d | 3 | 3 | 3 »4 | 4 »3 |
| 110e | 3 | 3 | 3 »4 | 4 »3 |

Since it is clearly not desirable to have the latch mechanisms 110*a* and 110*b* of the front door in a child safety on status, the common control 186 controls the stepper motors of the latch mechanisms 110*a* and 110*b* of the front doors to ensure that when the lock/unlock condition of the latch mechanisms 110*a* and 110*b* of the front door are synchronized with the latch mechanisms 110*c* and 110*d* of the rear door, the child safety on/off status remains child safety off.

In other words, the latch mechanisms 110*a* and 110*b* of the front doors have two operator selectable latch statuses (3rd and 4th) and two operator non-selectable latch statuses (1st and 2nd). The latch mechanisms 110*c* and 110*d* of the rear doors have four operator selectable latch statuses (1st, 2nd, 3rd and 4th).

Figure 19:
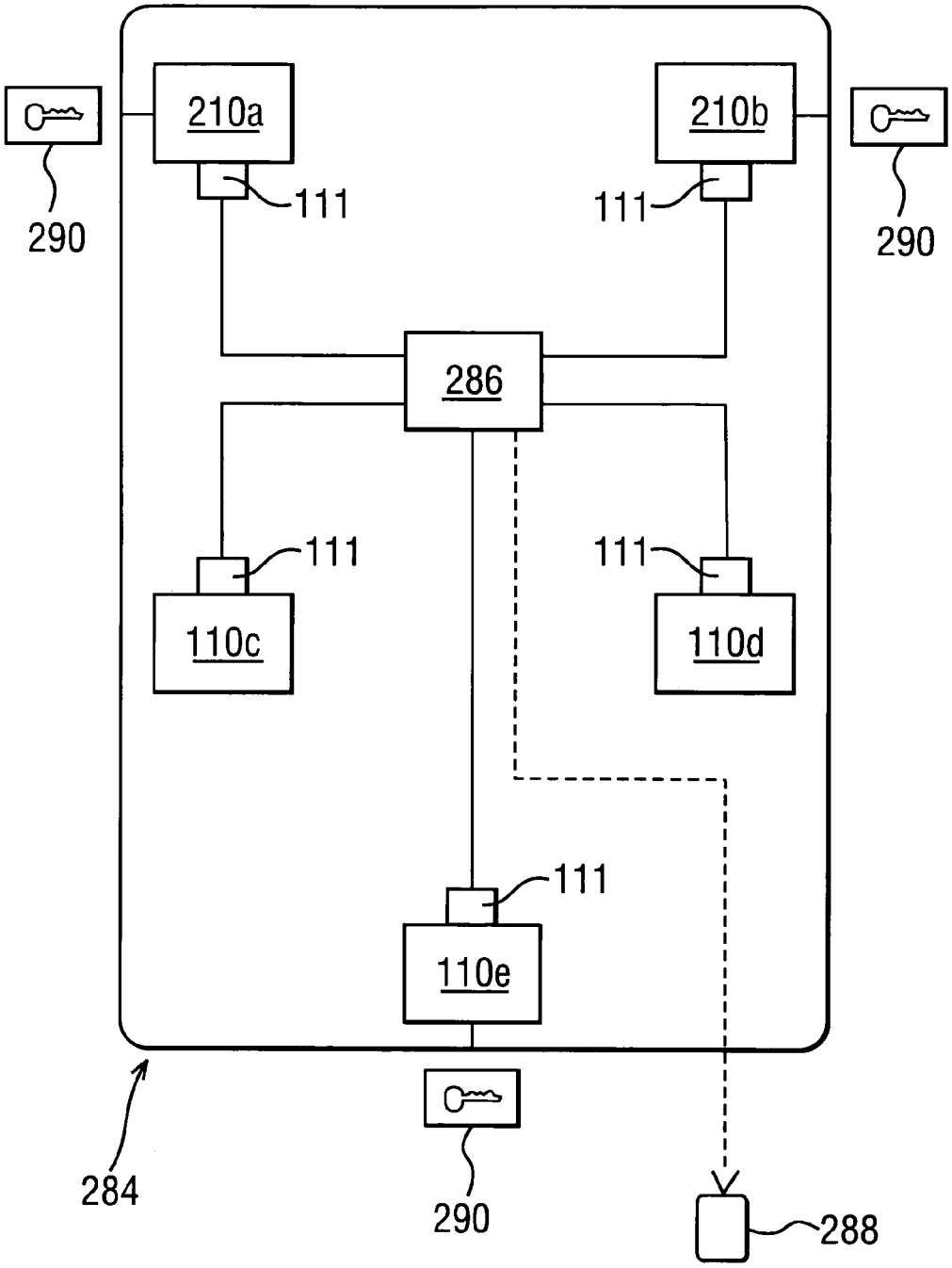
FIG. 19 is a schematic representation of a vehicle having two latch mechanism of FIG. 17, three latch mechanisms of FIGS. 11 to 16 and a latch of FIG. 7.

FIG. 19 shows a vehicle 286 similar to the vehicle 186 of FIG. 18, except that the two front doors include latch mechanisms 210*a* and 210*b* that are identical to the latch mechanism 210 of FIG. 17.

A summary of the operation of each of the latch mechanisms 210*a* and 210*b* is shown in the following table.

| LATCH MECHANISM 210 | | | | |
|---|---|---|---|---|
| Status Set | Latch Condition | Output Position | Fig No | Latch Status |
| 1st | 1st (locked) | 1 | 17 | 1st (locked Child Safety off) |

-continued

| LATCH MECHANISM 210 | | | | |
|---|---|---|---|---|
| Status Set | Latch Condition | Output Position | Fig No | Latch Status |
| 1st | 2nd (unlocked) | 2 | — | 2nd (unlocked Child Safety off) |
| 2nd | 1st (locked) | 3 | — | 3rd (locked Child Safety off) |
| 2nd | 2nd (unlocked) | 4 | — | 4th (unlocked Child Safety off) |

In use, the latch control system of the vehicle 284 works in a similar manner to that of the vehicle 184, except that latch mechanisms 210*a* and 210*b* can never achieve a child safety on status by virtue of the altered profile of the cam lobe 231. The altered profile means that the inside release lever 143 can always unlock the latch mechanisms 210*a* and 210*b* so that a vehicle occupant can release himself from the vehicle in the possible event of a crash or an accident. Consequently, the common control 286 simply synchronizes the output positions of the cams 230 of the latch mechanisms 210*a* and 210*b* and the cam 130 of the latch mechanisms 110*c*, 110*d* and 110*e*. The latch mechanisms 210*a* and 210*b* have four operator selectable latch statuses (1st, 2nd, 3rd and 4th). This is achieved by the altered cam profile which prevents the latch mechanisms 210*a* and 210*b* from achieving a child safety on status. In all other respects, operation of the vehicle 284 in FIG. 19 is similar to the operation of vehicle 184 in FIG. 18.

A summary of the operation of such a system can be seen in the following table, which shows the output positions of the latch mechanisms 210*a*, 210*b*, 110*c*, 110*d* and 110*e*. Note that the last two columns show how each stepper motor powers each output of each latch mechanism.

Similarly, the system can be operated as follows when the vehicle is left in an unlocked condition with the rear doors in a child safety off status.

| Latch Mechanism | All latch mechanisms locked | 210b manually unlocked | 210a manually unlocked | key fob electric lock |
|---|---|---|---|---|
| 210a | 3 | 3 | 3 »4 | 4 »3 |
| 210b | 3 | 4 | 4 »4 | 4 »3 |
| 110c | 3 | 3 | 3 »4 | 4 »3 |
| 110d | 3 | 3 | 3 »4 | 4 »3 |
| 110e | 3 | 3 | 3 »4 | 4 »3 |

The latch mechanism 110*e* is used as a trunk lid latch since the mechanism can be controlled to operate in a similar fashion to a rear door latch or a front door latch, i.e., with or without a child safety function. Equally, no inside release handle could be provided at all. The generic nature of this latch mechanism 110 allows the flexibility in application.

The foregoing description is only exemplary of the principles of the invention. Many modifications and variations of the present invention are possible in light of the above teachings. The preferred embodiments of this invention have been disclosed, however, so that one of ordinary skill in the art would recognize that certain modifications would come within the scope of this invention. It is, therefore, to be understood that within the scope of the appended claims, the invention may be practiced otherwise than as specifically described. For that reason the following claims should be studied to determine the true scope and content of this invention.

What is claimed is:

1. A latch comprising:

a displacement member having a first displacement position, a second displacement position, a first displacement rest position between the first displacement position and the second displacement position, a third displacement position, a fourth displacement position, and a second displacement rest position between the third displacement position and the fourth displacement position;

an actuator including an output movable between a first output position, a second output position, a third output position and a fourth output position which each correspond to a first latch status, a second latch status, a third latch status and a fourth latch status, respectively; and a stepper motor to drive the displacement member between the first displacement position, the second displacement position, the third displacement position, the fourth displacement position, the first displacement rest position, and the second displacement rest position, the displacement member engaging the output to move the output to the first output position when the displacement member is in the first displacement position, to the second output position when the displacement member is in the second displacement position, to the third output position when the displacement member is in the third displacement position, and to the fourth output position when the displacement member is in the fourth displacement position, wherein the first displacement position, the second displacement position, the first displacement rest position, the first output position and the second output position form a first status set, wherein the third displacement position, the fourth displacement position, the second displacement rest position, the third output position, and the fourth output position form a second status set, wherein the first latch status and the third latch status correspond to a first latch condition, and the second latch status and the fourth latch status correspond to a second latch condition, whereby powered movement of the displacement member from the first displacement rest position to the first displacement position and then powered returning of the displacement member to the first displacement rest position ensure the first latch status, powered movement of the displacement member from the first displacement rest position to the second displacement position and then powered returning of the displacement member to the first displacement rest position ensures the second latch status, powered movement of the displacement member from the second displacement rest position to the third displacement position and then powered returning of the displacement member to the second displacement rest position ensures the third latch status, and powered movement of the displacement member from the second displacement rest position to the fourth displacement position and then powered returning of the displacement member to the second displacement rest position ensures the fourth latch status, and wherein the displacement member and the output are engageable such that a latch status may be changed within one of the first status set and the second status set independently of the displacement member.

2. The latch according to claim 1 wherein the first status set is a child safety on status set and the second status set is a child safety off status set.

3. The latch according to claim 1 wherein the first status set and the second status set are both child safety off status sets, and the first latch condition corresponds to a locked status of the latch and the second latch condition corresponds to an unlocked status of the latch.

4. The latch according to claim 1 wherein the first latch condition corresponds to a locked status of the latch and the second latch condition corresponds to an unlocked status of the latch.

5. The latch according to claim 1 wherein the latch includes a latch body, the stepper motor, the displacement member and the output are mounted on the latch body, and the output and the displacement member have a common axis of rotation.

6. The latch according to claim 5 wherein the output and the displacement member are rotatable independently of each another and the latch body.

7. The latch according to claim 1 wherein the first output position, the second output position, the third output position and the fourth output position are sequential.

8. The latch according claim 1 wherein the displacement member moves the output to a superlocked output position corresponding to a superlocked latch status.

9. The latch according to claim 8 wherein the superlocked output position is arranged sequentially before the first output position.

10. The latch according claim 1 wherein the displacement member moves the output to a released output position corresponding to a released latch status.

11. The latch according to claim 10 wherein the released output position is arranged sequentially after the fourth output position.

12. The latch according to claim 1 wherein the output defines an arcuate slot, the displacement member includes a pin which acts in the arcuate slot to move the output between the first output position, the second output position, the third output position, and the fourth output position.

13. The latch according to claim 1 wherein the displacement member defines an arcuate slot, and the output includes a pin which acts in the arcuate slot to move the output between the first output position, the second output position, the third output position, and the fourth output position.

14. The latch according to claim 1 further including a latch status switch for providing a signal to indicate the latch status of the latch.

15. The latch according to claim 1 wherein the first displacement position, the second displacement position, the third displacement position, the fourth displacement position, the first displacement rest position and the second displacement rest position are all different positions of the displacement member.

16. The latch according to claim 1 wherein the first latch status and the second latch status are different.

17. A system comprising:

a first latch and a second latch each including:

a displacement member having a first displacement position, a second displacement position, a first displacement rest position between the first displacement position and the second displacement position, a third displacement position, a fourth displacement position, and a second displacement rest position between the third displacement position and the fourth displacement position;

an actuator including an output movable between a first output position, a second output position, a third output position and a fourth output position which each correspond to a first latch status, a second latch status, a third latch status and a fourth latch status, respectively; and a stepper motor to drive the displacement member between the first displacement position, the second displacement position, the third displacement position, the fourth displacement position, the first displacement rest position, and the second displacement rest position, the displacement member engaging the output to move the output to the first output position when the displacement member is in the first displacement position, to the second output position when the displacement member is in the second displacement position, to the third output position when the displacement member is in the third displacement position and to the fourth output position when the displacement member is in the fourth displacement position, wherein the first displacement position, the second displacement position, the first displacement rest position, the first output position and the second output position form a first status set, wherein the third displacement position, the fourth displacement position, the second displacement rest position, the third output position, and the fourth output position form a second status set, wherein the first latch status and the third latch status correspond to a first latch condition, and the second latch status and the fourth latch status correspond to a second latch condition, whereby powered movement of the displacement member from the first displacement rest position to the first displacement position and then powered returning of the displacement member to the first displacement rest position ensure the first latch status, powered movement of the displacement member from the first displacement rest position to the second displacement position and then powered returning of the displacement member to the first displacement rest position ensures the second latch status, powered movement of the displacement member from the second displacement rest position to the third displacement position and then powered returning of the displacement member to the second displacement rest position ensures the third latch status, and powered movement of the displacement member from the second displacement rest position to the fourth displacement position and then powered returning of the displacement member to the second displacement rest position ensures the fourth latch status, and wherein the displacement member and the output are engageable such that a latch status may be changed within one of the first status set and the second status set independently of the displacement member; and a common control, wherein the stepper motor of the first latch and the second stepper motor of the second latch are controlled by the common control.

18. The system according to claim 17 wherein the first output position, the second output position, the third output position and the fourth output position of the first latch each correspond to the first output position, the second output position, the third output position and fourth output position of the second latch, wherein each of the first latch status, the second latch status, the third latch status, and the fourth latch status of the first latch are operator selectable, wherein the first latch status and the second latch status of the second latch are operator selectable, wherein the third latch status and the fourth latch status of the second latch are operator non-selectable, and wherein, with the output of the first latch and the output of the second latch in different output positions and upon powered operation of the system, the common control powers the stepper motor of the first latch and the stepper motor of the second latch to move each of the displacement member of the first latch and the displacement member of the second latch within respective status sets to ensure synchronization of both the first latch and the second latch in one of the first latch condition and the second latch condition within the respective status sets and then powers each of the displacement member of the first latch and the displacement member of the second latch to a displacement rest position within the respective status set.

19. The system according to claim 18 wherein the first status set of each of the first latch and the second latch is a child safety on status set and the second status set of each of the first latch and the second latch is a child safety off status set.

20. The system according to claim 18 wherein the first latch condition corresponds to a locked status of the first latch and the second latch condition corresponds to an unlocked status of the first latch.

21. The system according to claim 18 wherein at least one of the first latch and the second latch includes a latch status switch that provides a signal to the common control to indicate the latch status of the first latch and the second latch.

22. The system according to claim 17 wherein the first output position, the second output position, the third output position and the fourth output position of the first latch each correspond to the first output position, the second output position, the third output position and the fourth output position of the second latch, wherein each of the first latch status, the second latch status, the third latch status, and the fourth latch status of the first latch are operator selectable, wherein each of the first latch status, the second latch status, the third latch status, and the fourth latch status of the second latch are operator selectable, wherein with the output of the first latch and the output of the second latch in different output positions and upon powered operation of the system, the common control powers the stepper motor of the first latch and the stepper motor of the second latch to move each of the displacement member of the first latch and the displacement member of the second latch within respective status sets to ensure synchronization of both the first latch and the second latch in one of the first condition and the second condition within the respective status sets, and then powers each of the displacement member of the first latch and the displacement member of the second status to one of the first displacement rest position and the second displacement rest position.

23. The system according to claim 22 wherein the first status set of the first latch is a child safety on status set and the second status set of the first latch is a child safety off status set.

24. The system according to claim 22 wherein the first status set and the second status set of the second latch are child safety off status sets.

25. The system according to 22 wherein the first latch condition corresponds to a locked status of the first latch and the second latch condition corresponds to an unlocked status of the first latch.

26. The system according to claim 17 wherein the first displacement position, the second displacement position, the third displacement position, the fourth displacement position, the first displacement rest position and the second displacement rest position are all different positions of the displacement member.

27. The system according to claim 17 wherein the first latch status and the, second latch status are different.

* * * * *

UNITED STATES PATENT AND TRADEMARK OFFICE

CERTIFICATE OF CORRECTION

PATENT NO. : 7,234,737 B2
APPLICATION NO. : 10/960651
DATED : June 26, 2007
INVENTOR(S) : Kalsi It is certified that error appears in the above-identified patent and that said Letters Patent is hereby corrected as shown below:

Claim 8, Column 16, line 28: Insert --to-- after “according” and before “claim”

Claim 10, Column 16, line 34: Insert --to-- after “according” and before “claim”

Claim 25, Column 19, line 4: Insert --claim-- after “to” and before “22”

Signed and Sealed this

Fourth Day of December, 2007

JON W. DUDAS
*Director of the United States Patent and Trademark Office*